US012702192B2

(12) United States Patent
Tateno et al.

(10) Patent No.: US 12,702,192 B2
(45) Date of Patent: Aug. 11, 2026

(54) SHOE WITH CUT IN THE SOLE

(71) Applicant: ASICS CORPORATION, Kobe (JP)

(72) Inventors: Kenta Tateno, Kobe (JP); Hiroaki Nishimura, Kobe (JP); Takayuki Kogure, Kobe (JP); Yoshikazu Mitsuhata, Kobe (JP); Hiromichi Otake, Kobe (JP)

(73) Assignee: ASICS CORPORATION, Kobe City (JP)

( * ) Notice: Subject to any disclaimer, the term of this patent is extended or adjusted under 35 U.S.C. 154(b) by 29 days.

(21) Appl. No.: 17/890,944

(22) Filed: Aug. 18, 2022

(65) Prior Publication Data

US 2023/0062543 A1 Mar. 2, 2023

(30) Foreign Application Priority Data

Aug. 25, 2021 (JP) ..... 2021-136888

(51) Int. Cl.
*A43B 13/18* (2006.01)

(52) U.S. Cl.
CPC ..... *A43B 13/181* (2013.01); *A43B 13/18* (2013.01)

(58) Field of Classification Search
CPC ..... A43B 13/181; A43B 13/18; A43B 13/00
USPC ..... 36/25 R
See application file for complete search history.

(56) References Cited

U.S. PATENT DOCUMENTS 4,956,927 A 9/1990 Misevich et al.
6,065,230 A * 5/2000 James ..... A43B 13/187 36/25 R
6,115,945 A * 9/2000 Ellis, III ..... A43B 13/148 36/102
6,295,744 B1 * 10/2001 Ellis, III ..... A43B 13/146 36/114
6,990,755 B2 1/2006 Hatfield et al.
7,392,605 B2 * 7/2008 Hatfield ..... A43B 7/06 36/97
8,303,885 B2 * 11/2012 Hatfield ..... A43B 7/06 264/328.1
9,717,303 B2 * 8/2017 Walker ..... A43B 13/141
9,943,134 B2 * 4/2018 Holmes ..... A43B 13/141
10,966,482 B2 * 4/2021 Aubonnet ..... A43B 13/188
11,058,175 B2 * 7/2021 Cross ..... A43B 13/122
11,129,437 B2 * 9/2021 Cross ..... A43B 13/12
11,358,358 B2 * 6/2022 Cross ..... A43B 13/32
(Continued)

FOREIGN PATENT DOCUMENTS

JP H0161104 U 4/1989
JP 2271804 A 11/1990
(Continued)

OTHER PUBLICATIONS

Notice of Reasons for Refusal issued Dec. 12, 2024 for corresponding Japanese Application No. 2021-136888.

*Primary Examiner* — Marie D Bays
(74) *Attorney, Agent, or Firm* — Spencer Fane, LLP

(57) ABSTRACT

A shoe includes a sole with a midsole, and an upper portion joined to the sole. The midsole includes a cut having a linear shape, and a depth from a first height position to a second height position in a thickness direction. The cut is configured such that a part of the cut has no contact point with an other part of the cut, and the cut forms a V shape at the deepest part on a cross section when opposite inner walls of the cut are spaced from each other.

17 Claims, 29 Drawing Sheets

(56) References Cited

U.S. PATENT DOCUMENTS

| | | | | |
|---|---|---|---|---|
| 11,684,119 | B2 * | 6/2023 | Cross | A43B 13/28 36/15 |
| 11,730,228 | B2 * | 8/2023 | Diard | A43B 13/187 36/28 |
| 2005/0262739 | A1 * | 12/2005 | McDonald | A43B 13/16 36/102 |
| 2008/0229617 | A1 * | 9/2008 | Johnson | A43B 3/0057 36/102 |
| 2009/0013558 | A1 * | 1/2009 | Hazenberg | A43B 13/18 521/50 |
| 2011/0126428 | A1 * | 6/2011 | Hazenberg | A43B 13/122 36/12 |
| 2011/0214313 | A1 * | 9/2011 | James | A43B 13/16 36/103 |
| 2013/0152428 | A1 * | 6/2013 | Bishop | A43B 13/141 36/31 |
| 2014/0013624 | A1 * | 1/2014 | Stockbridge | A43B 13/181 36/103 |
| 2014/0041261 | A1 * | 2/2014 | Walker | A43B 13/223 36/25 R |
| 2014/0259744 | A1 * | 9/2014 | Cooper | A43B 3/0057 36/28 |
| 2015/0089841 | A1 * | 4/2015 | Smaldone | A43B 13/122 36/103 |
| 2015/0223560 | A1 | 8/2015 | Wawrousek et al. | |
| 2015/0250260 | A1 * | 9/2015 | Bessho | A43B 7/18 36/25 R |
| 2017/0099907 | A1 * | 4/2017 | Cin | A43B 23/0205 |
| 2018/0295935 | A1 * | 10/2018 | Giandolini | A43B 13/141 |
| 2018/0338567 | A1 | 11/2018 | Xanthos | |
| 2019/0366667 | A1 * | 12/2019 | Cross | A43B 13/32 |
| 2020/0205515 | A1 * | 7/2020 | Cross | A43B 13/14 |
| 2020/0237049 | A1 | 7/2020 | Xanthos | |
| 2022/0039506 | A1 * | 2/2022 | Diard | A43B 3/0042 |
| 2023/0075506 | A1 * | 3/2023 | Vawter | A43B 13/141 |
| 2024/0122294 | A1 * | 4/2024 | Zheng | A43B 7/32 |

FOREIGN PATENT DOCUMENTS

| | | | |
|---|---|---|---|
| JP | 2000116405 | A | 4/2000 |
| JP | 2004180746 | A | 7/2004 |
| JP | 2007508055 | A | 4/2007 |
| JP | 2019063491 | A | 4/2019 |

* cited by examiner

SHOE WITH CUT IN THE SOLE

CROSS-REFERENCE TO RELATED APPLICATION

This application claims priority to Japanese Application No. 2021-136888, filed Aug. 25, 2021, the contents of which are hereby incorporated by reference in their entirety.

FIELD OF THE INVENTION

The present disclosure relates to a shoe. In particular, the present disclosure relates to a sole structure.

BACKGROUND INFORMATION

In recent years, the running shoe market has seen accelerated development of midsole and outsole materials, and there is a demand for shoes that have higher impact buffering properties and are comfortable in running.

To increase the flexibility of the sole, conventional techniques can provide a groove that forms a void in the midsole. See for example, the following references: U.S. Patent Application Publication No. 2020/0237049A1, Japanese Unexamined Patent Application Publication No. 2-271804, Japanese Unexamined Patent Application Publication No. 2019-63491 and U.S. Patent Application Publication No. 2015/0223560A1.

SUMMARY

As technological innovation of recent years has made midsole materials lighter, an increasing number of conventional shoes have thicker soles in order to improve impact buffering properties. However, it has been determined that the greater the sole thickness, the greater the distance from the ground to the body's center of gravity, so that unconsidered increase in sole thickness can lead to deterioration in stability. Therefore, from the perspective of injury prevention and performance maintenance, more stability is required for shoes.

In the technologies described in the references above, however, it has been determined that since a void is provided, the volume of the foam material, which should normally contribute to the repulsion and stability, is reduced. Therefore, in terms of improving the stability, these technologies are not preferable.

Embodiments of the present invention have been made in view of such a situation, and a purpose thereof is to provide a technology for improving impact buffering properties while maintaining stability in a midsole.

In response to the above issue, a shoe according to one aspect of the present invention includes a sole including a midsole, and an upper portion joined to the sole. In a midsole, at least one cut of linear shape is provided which has a depth from a first height position to a second height position in a thickness direction. The cut is configured such that part of the cut has no contact point with other part of the cut. Also, the cut forms a V shape at the deepest part on a cross section when the opposite inner walls of the cut are spaced away from each other.

The "sole" can include a member besides the midsole, such as an outsole. Also, the "midsole" can be constituted by a single member formed integrally or can be constituted by multiple layer members laminated together. The "midsole" can be formed of resin foam made of a polyolefin resin, a polyurethane resin, a nylon resin, or an ethylene-vinyl acetate copolymer, for example. The "cut" can be provided such as to be perpendicular to the ground or can be obliquely provided at a predetermined angle to the ground, from the first height position to the second height position.

According to this aspect, shear deformation of the midsole, with the cut as a boundary, can be promoted when a load is applied to the midsole, so that the impact buffering properties can be further improved, compared to a midsole without the cut. Also, since the deepest part of the cut is made to form a V shape, the gap is formed minimally, and the volume reduction in the foam material is also minimized compared to a midsole without the cut, so that the repulsion and the stability is improved.

The cut can be provided in an area locally lying in at least one of a forefoot region, a midfoot region, or a heel region of the midsole. Thus, depending on which region a cut is provided locally in, the impact buffering properties can be promoted based on properties such as the direction of impact applied at the time of landing and the movements of the foot, or a certain movement can be restrained.

The cut can be provided in an area locally lying in at least one of a lateral region or a medial region of the midsole. Thus, depending on whether a cut is provided locally in an area on the lateral side or the medial side, the impact buffering properties can be promoted based on properties such as the direction of impact applied at the time of landing and the movements of the foot, or a certain movement can be restrained.

The cut can be provided in a region other than a region where a load applied while the shoe is worn is relatively smaller or relatively larger than other regions. By removing a region where the load is small, the machining range of a cut can be reduced, and the manufacturing process can be simplified. Also, by removing a region where the load is large, the stability can be improved.

The cut can be provided at multiple discrete positions and have a certain linear shape. By providing cuts forming a pattern of certain shape, the impact buffering properties can be improved. Also, by arranging the patterns discretely at certain intervals, the stability can be improved.

The cut can be provided at multiple positions at intervals such that the density in the area locally lying differs from the density in another area. By making the density in each region where a cut is provided different, while the impact buffering properties in a specific region can be improved, the stability in a specific region can also be improved.

The cut can be formed such that the depth thereof differs according to the difference in distance to an end of the midsole. By making the depth of a cut different depending on the position, such as changing the depth of a cut from shallow to deep gradually, smooth weight shift can be promoted.

The cut can be formed in an oblique direction from a front medial portion to a rear lateral portion or from a front lateral portion to a rear medial portion. This can prevent or promote a movement in a specific direction and also can prevent medial twisting or lateral twisting of a foot.

The cut can be formed on at least one of an upper surface or a lower surface of the midsole. Depending on whether a cut is provided on the upper surface or the lower surface of the midsole, the feel of shear deformation of the midsole can be changed, or the impact buffering properties can be improved.

BRIEF DESCRIPTION OF THE DRAWINGS

Embodiments of invention will be explained in more detail hereinafter with reference to the drawings.

FIGS. 5A-5C illustrate a top view and end views of cut sections that schematically show a midsole in a second embodiment;

FIGS. 26A2-6E are top views that schematically show the shape and arrangement of cuts in ninth through twelfth examples of the tenth embodiment;

DETAILED DESCRIPTION

Figure 1:
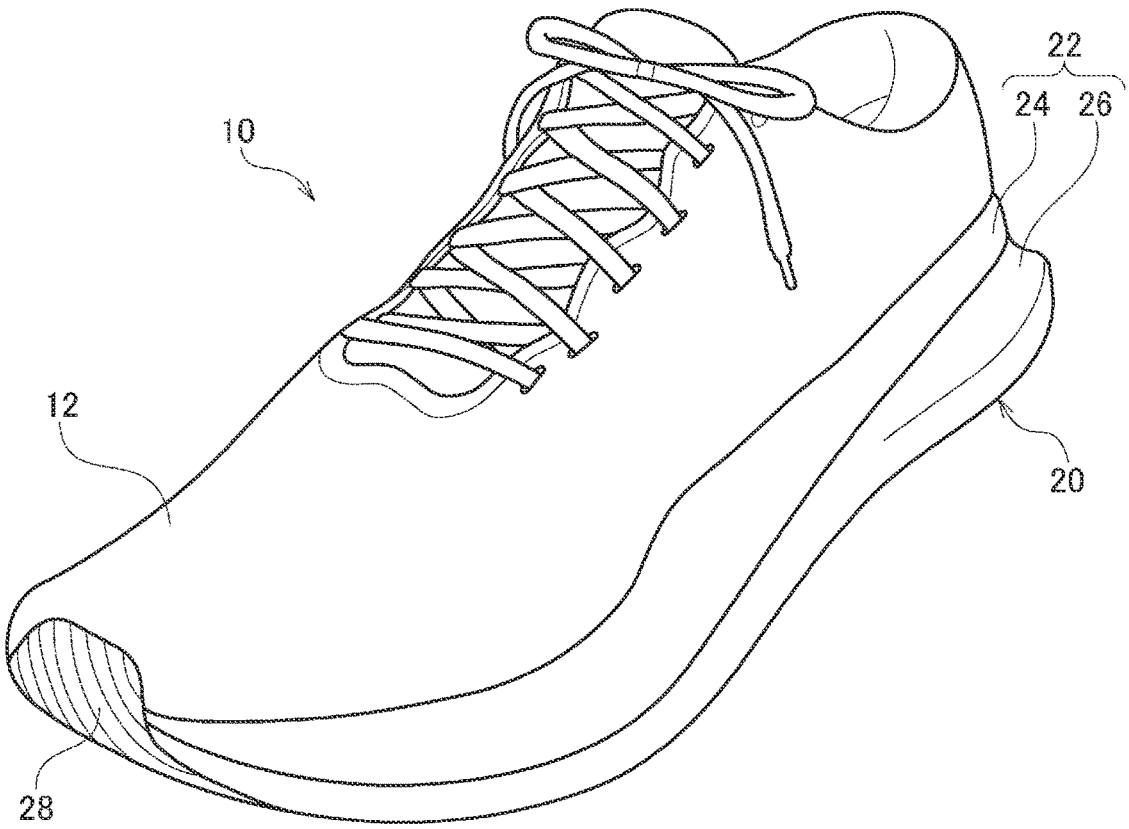
FIG. 1 is a perspective view of a shoe according to a first embodiment, viewed obliquely from the front left side.

The invention will now be described by reference to the preferred embodiments.

This does not intend to limit the scope of the present invention, but to exemplify the invention.

In the following, the present invention will be described based on preferred embodiments with reference to each drawing. In the embodiments and modifications, like reference characters denote like or corresponding constituting elements and members, and the repetitive description will be omitted as appropriate. The dimensions of a member can be appropriately enlarged or reduced in each drawing in order to facilitate understanding. In each drawing, part of members less important in describing embodiments can be omitted.

In each embodiment and each modification, various modes of "cuts" and the respective functions thereof will be described. A mode of a cut in one embodiment and a mode of a cut in another embodiment or a modification can be adoptable together in a shoe or can not necessarily be adoptable together. Also, a mode of a cut in one embodiment can have an opposite function or effect to a mode of a cut in another embodiment or a modification. Thus, the multiple embodiments and modifications cover the modes of "cuts" in all directions because the skeletal structures and characteristics of human feet, the ways of running, the ways of landing, the running abilities, and the uses of shoes, for example, are all different. Therefore, as the specification of a shoe, one or more modes of "cuts" among the multiple embodiments and modifications can be employed so that one or more modes of "cuts" can be selected from among the multiple embodiments and modifications based on the specification of a shoe to be realized as a product and so that a wearer can select shoes from among shoes with multiple specifications based on the wearer's own characteristics and requests.

In the following, the first and second embodiments will describe examples of a mode in which one cut does not intersect with other parts of the same cut or other cuts, and the third and subsequent embodiments will describe examples of a mode in which one cut can intersect with other parts of the same cut or other cuts. Also, the first through fifth embodiments will describe examples of a midsole formed by a single layer member, and the sixth embodiment will describe an example of midsole formed by multiple layer members.

First Embodiment

FIG. 1 is a perspective view of a shoe according to the first embodiment, viewed obliquely from the front left side. In the following, a configuration of a shoe 10 according to the present embodiment will be described with reference to the drawings.

Each drawing mentioned below, including FIG. 1, illustrates a shoe and the components thereof for a left foot, unless otherwise specified. However, the description in the present specification is also similarly applicable to a shoe and the components thereof for a right foot.

The shoe 10 of the present embodiment is a laced shoe used for sports such as running or walking. The shoe 10 includes an upper portion 12, a shoelace 14, a shoe tongue 16, and a sole 20.

The upper portion 12 is joined, at its hem, to the sole 20 to form an internal space for accommodating a wearer's foot. When a wearer puts the shoe 10 on, the upper portion 12 wraps the entire upper portion of the foot. The upper portion 12 and the sole 20 are joined together by bonding or the like.

The shoe tongue 16 is provided such as to close an instep opening from the inner side of the upper portion 12, i.e., the internal space side, and covers an area from a front part of the ankle to the instep of the wearer. The shoelace 14 is made to pass through multiple eyelets and intersect on the shoe tongue 16. When the shoelace 14 is tightened, downward pressing force caused by the tightening force is applied to the wearer's instep via the shoe tongue 16, so that the shoe tongue 16 fits the wearer's instep.

The sole 20 is configured to mainly include a midsole 22 and an outsole 28. More specifically, the midsole 22 is overlapped and bonded onto the outsole 28, which is a portion to be in contact with the ground. Also, onto the midsole 22, an inner sole 21 is overlapped and bonded. Further, at the position of the heel, a heel counter 29 is bonded. Since the inner sole 21 and the heel counter 29 are provided inside the upper portion 12 and invisible from the outside, they are indicated by dotted lines in the drawing. In an actual product, an insole, not illustrated, is inserted into the internal space and laid on the bottom, i.e., on the inner sole 21. The inner sole 21 and the heel counter 29 are not essential components and can be omitted from the sole 20, as appropriate.

The midsole 22 is formed of a sponge material for buffering the landing impact, such as resin foam made of a polyolefin resin, a polyurethane resin, a nylon resin, or an ethylene-vinyl acetate copolymer. The midsole 22 of the present embodiment is constituted by a single layer member formed integrally.

Figures 2A, 2B, 2C:
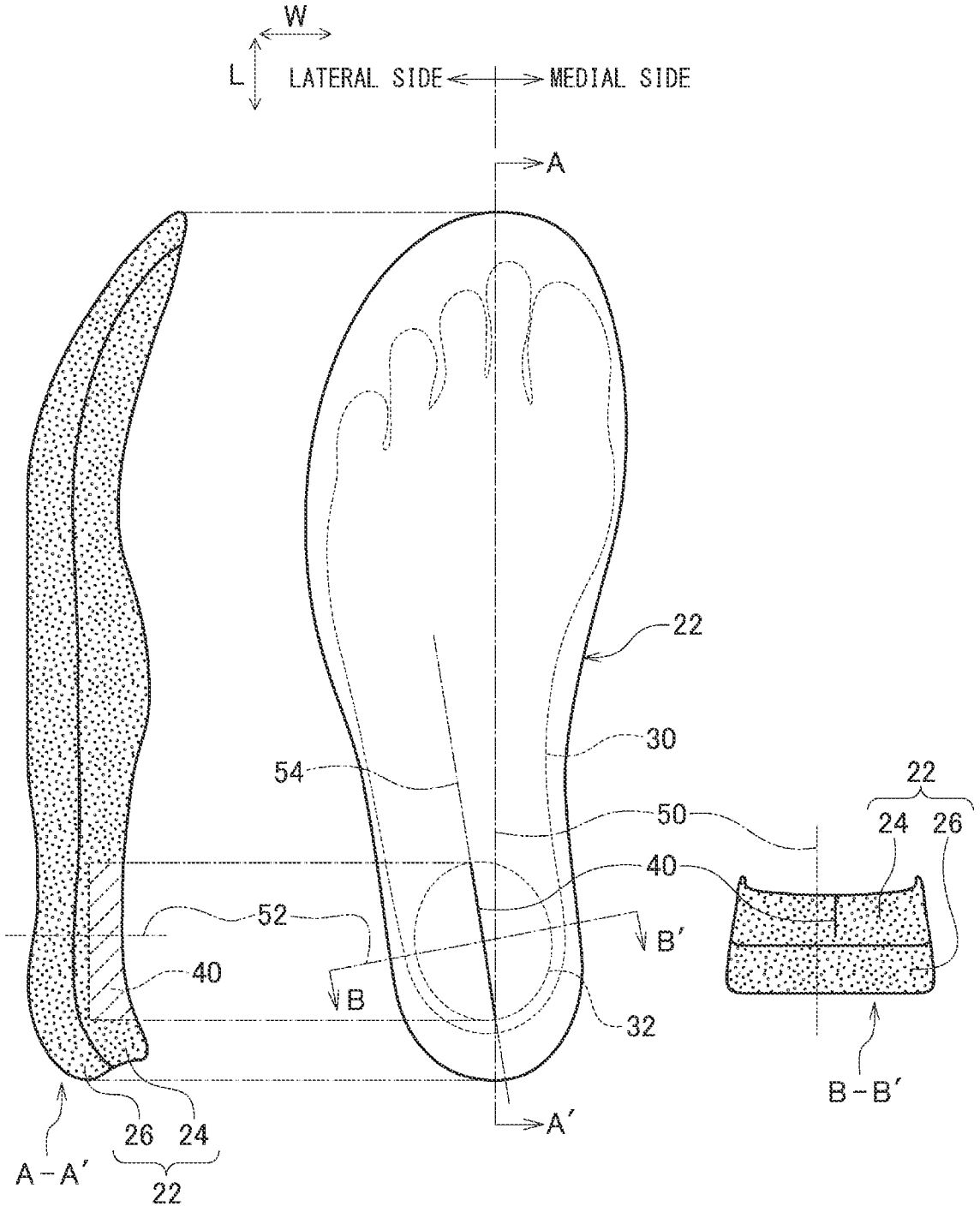
FIGS. 2A-2C illustrate a top view and end views of cut sections that schematically show a midsole.

FIGS. 2A-2C shows a top view and end views of cut sections that schematically show the midsole 22. In the top view shown in the middle of FIGS. 2A-2C, a foot region 30 where a wearer's foot is placed is indicated by a dotted line, and a heel region 32 that corresponds to a wearer's heel is also indicated by a dotted line. Also, a first cutting plane line 50, which connects the center of the toe and the center of the heel, is indicated by a dashed dotted line, and a heel axis line 54, which connects the center of the heel and the center of a midfoot portion, is also indicated by a dashed dotted line. The right side of the first cutting plane line 50 in FIGS. 2A-2C is referred to as a "medial side", and the left side of the first cutting plane line 50 in FIGS. 2A-2C is referred to as a "lateral side". In a right-foot shoe, the medial side and the lateral side are reversed from left to right. The arrow W pointing to the left and right in FIGS. 2A-2C indicates foot width directions of the shoe 10 or the midsole 22, and the arrow L pointing upward and downward in FIGS. 2A-2C indicates longitudinal directions of the shoe 10 or the midsole 22.

The heel axis line 54 is not parallel to the first cutting plane line 50 and is located at an angle to the first cutting plane line 50 on the lateral side, i.e., an angle inclined to the lateral side based on the heel. The heel region 32 is elliptic in shape with its major axis aligned with the heel axis line 54, and at least one cut 40 of linear shape is provided along the major axis. In the example of FIGS. 2A-2C, the heel region 32 where the cut 40 is provided is shown as an ellipse. However, it is illustrated using an ellipse for the sake of convenience merely as a shape almost covering the heel, and the shape of the region where the cut 40 is actually provided is not limited to an ellipse. Also in each drawing mentioned below, each shape indicated by a dotted line as a region where a cut 40 is provided is merely an expediential shape for illustration and does not limit the shape of the region where the cut 40 is actually provided.

The number of cut 40 provided in the present embodiment is one. Also, the cut 40 in the present embodiment is formed linearly in top view and configured to have a shape in which part of the cut has no contact point with other part of the cut. In other words, part of the cut does not form a loop due to intersection or contact with other part of the cut. Also, one linear cut 40 can substantially include a linear cut 40 in the form of, besides a solid line, a dotted line or a chain line in which short linear cuts are provided linearly and continuously at certain intervals. Also, a linear cut 40 is not limited to a straight line and can also be a curved line. Also in each drawing mentioned below, each linear cut can be any of solid, dotted, chain, straight, and curved lines.

An end view of the A-A' cut section taken along the first cutting plane line 50 is illustrated on the left. Also, an end view of the B-B' cut section taken along the minor axis of the heel region 32 is illustrated on the right. In the end view of the A-A' cut section, although the cut 40 itself does not appear on the end surface, the position where the cut 40 is projected is indicated by dotted diagonal lines. The depth of the cut 40 is less than half the thickness of the midsole 22, such as about one-third the thickness of the midsole 22. In the end view of the B-B' cut section, the cut 40 is shown at a position slightly shifted from the first cutting plane line 50 to the lateral side.

Figure 3A:
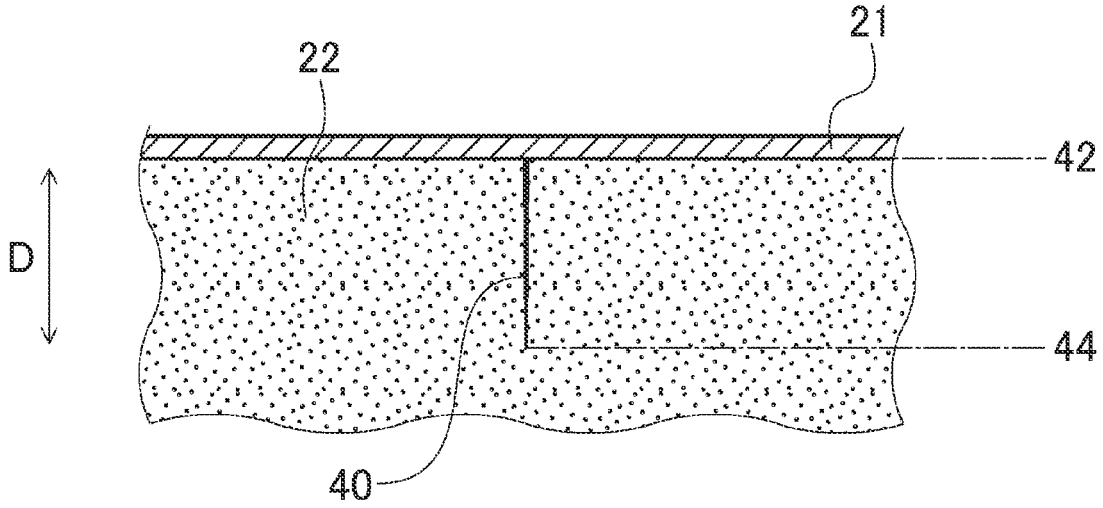
FIGS. 3A and 3B are magnified end views that show the shape of a cut in the midsole.
Figure 3B:
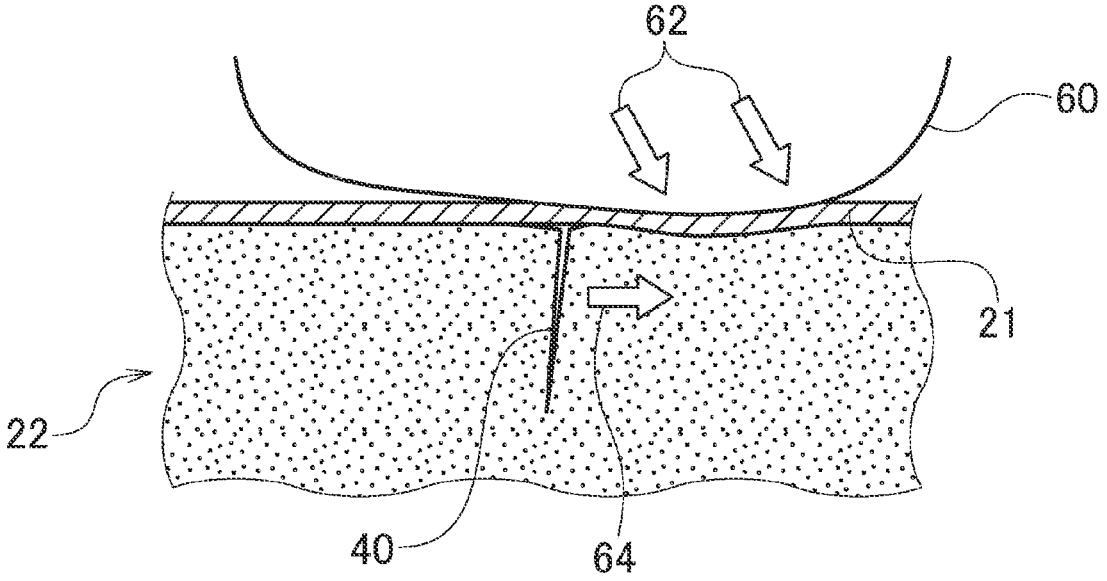

FIGS. 3A and 3B are magnified end views that show the shape of the cut 40 in the midsole 22. FIG. 3A shows a state where the midsole 22 is not deformed, such as when a foot is not inserted into the shoe 10. The arrow D indicates thickness directions of the midsole 22. Onto the midsole 22, the inner sole 21 is bonded.

In the midsole 22, the cut 40 is provided which has a depth from a first height position (a start position 42) to a second height position (a deepest position 44) in a thickness direction. In a modification, the start position 42 does not have to be a position of the upper surface of the midsole 22, and both the start position 42 and the deepest position 44 can be set lower than the upper surface and higher than the lower surface of the midsole 22 in a thickness direction D, for example. In other words, the cut 40 can be provided at a depth such as not to appear on the upper surface or lower surface of the midsole 22. Alternatively, the cut 40 can be provided such as to penetrate from the upper surface to the lower surface of the midsole 22.

The cut 40 forms a V shape at the deepest part on a cross section when the opposite inner walls thereof are spaced away from each other. However, since the space between the inner walls is almost none or significantly small, such as less than 1 millimeter (about 0.5 millimeters, for example), in a normal state and the inner walls can be in contact with each other, the shape of the deepest part hardly appears on a cross section in a normal state. In this respect, the cut 40 is different from a groove, a slit, or a sipe, in which the inner walls are assumed to be separated from each other with a certain space in between and spaced apart all the way to the bottom, and a narrow internal bottom face is formed.

When the cut 40 is formed by cutting part of the midsole 22 using a tool, such as a cutting blade, it merely corresponds to cutting of a member and hence the volume of the midsole 22 is not reduced. Meanwhile, when the cut 40 is made in part of the midsole 22 by short pulse laser processing, such as nanosecond laser processing, since the member is slightly melt, the volume of the midsole 22 can be reduced by a gap of less than 1 millimeter in width. When the cut 40 is made by ultra-short pulse laser processing, such as femtosecond laser processing, the melt of the member is less than that in short pulse laser processing. Also, the cut 40 can be provided at an unexposed internal location away from the outer surfaces of the midsole 22 by local three-dimensional machining with the ultra-short pulse laser focused on the interior of the midsole 22. With such internal machining techniques, even after the shoe 10 has become a product with the outsole 28, inner sole 21, upper portion 12, and the like already bonded, the cut 40 can be provided by applying ultra-short pulse laser to a specific position of the midsole 22. In such a case, personalized cutting can be achieved at a store or the like by adding the cut 40 to the midsole 22 in a mode optimized for the wearer, based on data regarding the wearer's foot or running.

FIG. 3B shows a state where a foot is inserted into the shoe 10, to which a load is hence applied. When the load of a foot 60 is applied, due to landing or the like, toward the lower right in FIG. 3B, as shown by arrows 62 indicating the direction of the load, and when the internal walls of the cut 40 are slightly separated such that the cut 40 opens to create a gap, a V shape on a cross section can appear in a bottom part of the cut 40, as illustrated in FIG. 3B.

In the present embodiment, one cut 40 is provided in a foot length direction in the heel region 32, so that, when a load is applied in the medial direction or the lateral direction at the time of landing, for example, shear deformation of the midsole 22, with the cut 40 as a boundary, can be promoted. This can further improve the impact buffering properties, compared to the midsole 22 without the cut 40. Also, since the deepest part of the cut is made to form a V shape, the gap is formed minimally, and the volume reduction in the foam material is also minimized compared to a midsole without the cut, so that the repulsion and the stability is improved.

In a modification, one linear cut 40 can be provided along a direction other than the foot length directions in the heel region 32. For example, in the case where the cut 40 is provided in a foot width direction along a second cutting plane line 52 shown in FIGS. 2A-2C, shear deformation of the midsole 22 with the cut 40 as a boundary can be promoted when a load is applied from the rear side to the front side in heel landing. This can further improve the impact buffering properties, compared to the midsole 22 without the cut 40. Also, two or more linear cuts 40, which do not intersect each other, can be provided in the heel region 32. In the following, a modification in which two non-intersecting cuts are provided will be described. However, in another modification, three or more non-intersecting cuts can be provided.

Figure 4A:
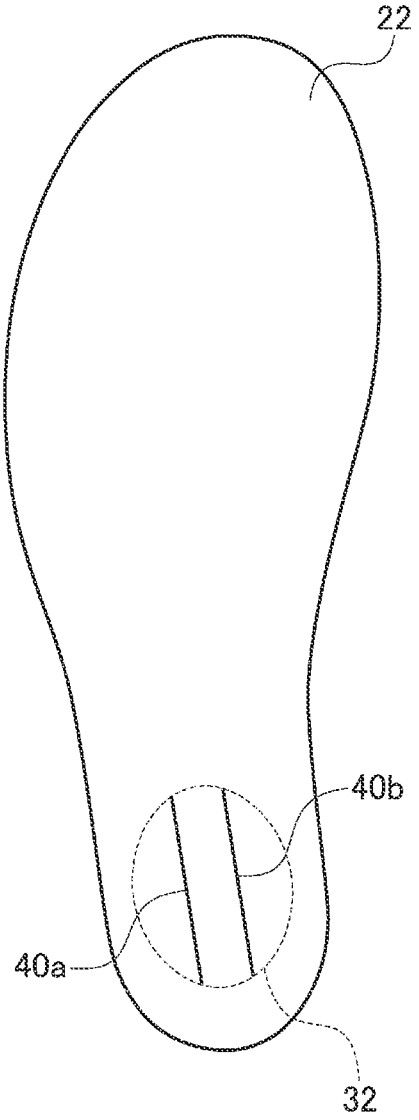
FIGS. 4A and 4B are top views that schematically show the positions of cuts in first and second modifications of the first embodiment.
Figure 4B:
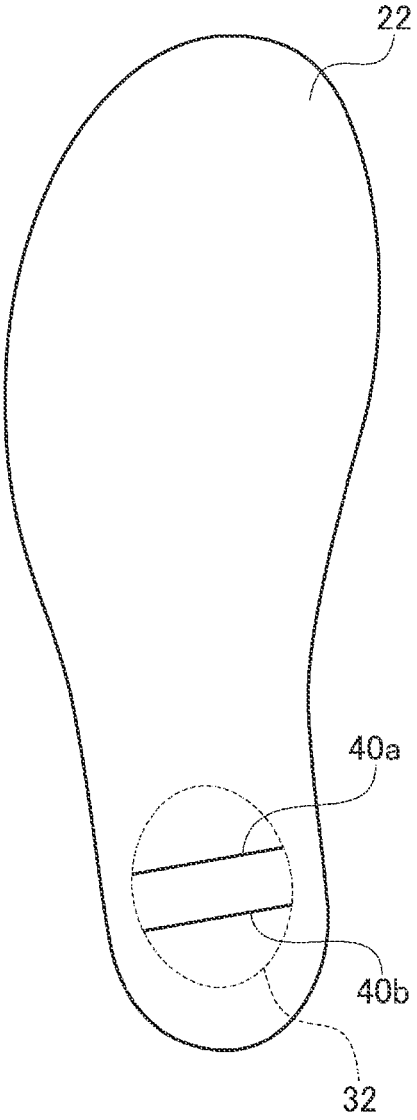

FIGS. 4A and 4B are top views that schematically show the positions of cuts in first and second modifications of the first embodiment. In the modifications of FIGS. 4, two cuts are provided in various modes in the heel region 32 of the midsole 22.

In the first modification shown in FIG. 4A, two cuts (a first cut 40*a* and a second cut 40*b*) parallel to the major axis of the heel region 32 are provided. The first cut 40*a* and the second cut 40*b* need not be parallel, as long as they do not intersect each other.

The first cut 40*a* is formed linearly in top view and configured to have a shape in which part of the cut has no contact point with other part of the cut. In other words, part of the cut does not form a loop due to intersection or contact with other part of the cut.

The second cut 40*b* is also formed linearly in top view and configured to have a shape in which part of the cut has no contact point with other part of the cut. In other words, part of the cut does not form a loop due to intersection or contact with other part of the cut.

In the first modification of the first embodiment, the two cuts 40 are provided in a foot length direction in the heel region 32, so that, when a load is applied in the medial direction or the lateral direction at the time of landing, for example, shear deformation of the midsole 22 can be further promoted, compared to the case where a single cut is provided. Therefore, the impact buffering properties can be further improved.

In the second modification shown in FIG. 4B, two cuts (a first cut 40*a* and a second cut 40*b*) parallel to the minor axis of the heel region 32 are provided. The first cut 40*a* and the second cut 40*b* need not be parallel, as long as they do not intersect each other.

The first cut 40*a* is formed linearly in top view and configured to have a shape in which part of the cut has no contact point with other part of the cut. In other words, part of the cut does not form a loop due to intersection or contact with other part of the cut.

The second cut 40*b* is also formed linearly in top view and configured to have a shape in which part of the cut has no contact point with other part of the cut. In other words, part of the cut does not form a loop due to intersection or contact with other part of the cut.

In the second modification of the first embodiment, the two cuts 40 are provided in a foot width direction in the heel region 32, so that, when a load is applied from the rear side to the front side at the time of landing, for example, shear deformation of the midsole 22 can be further promoted, compared to the case where a single cut is provided.

Therefore, the impact buffering properties can be further improved.

Second Embodiment

In the present embodiment, one linear cut 40 is provided in a forefoot region, which differs from the first embodiment in which a cut 40 is provided in the heel region. In the following, description will be given mainly for the differences from the first embodiment, and the explanation of features in common will be omitted.

Figures 5, 5A, 5B, 5C:
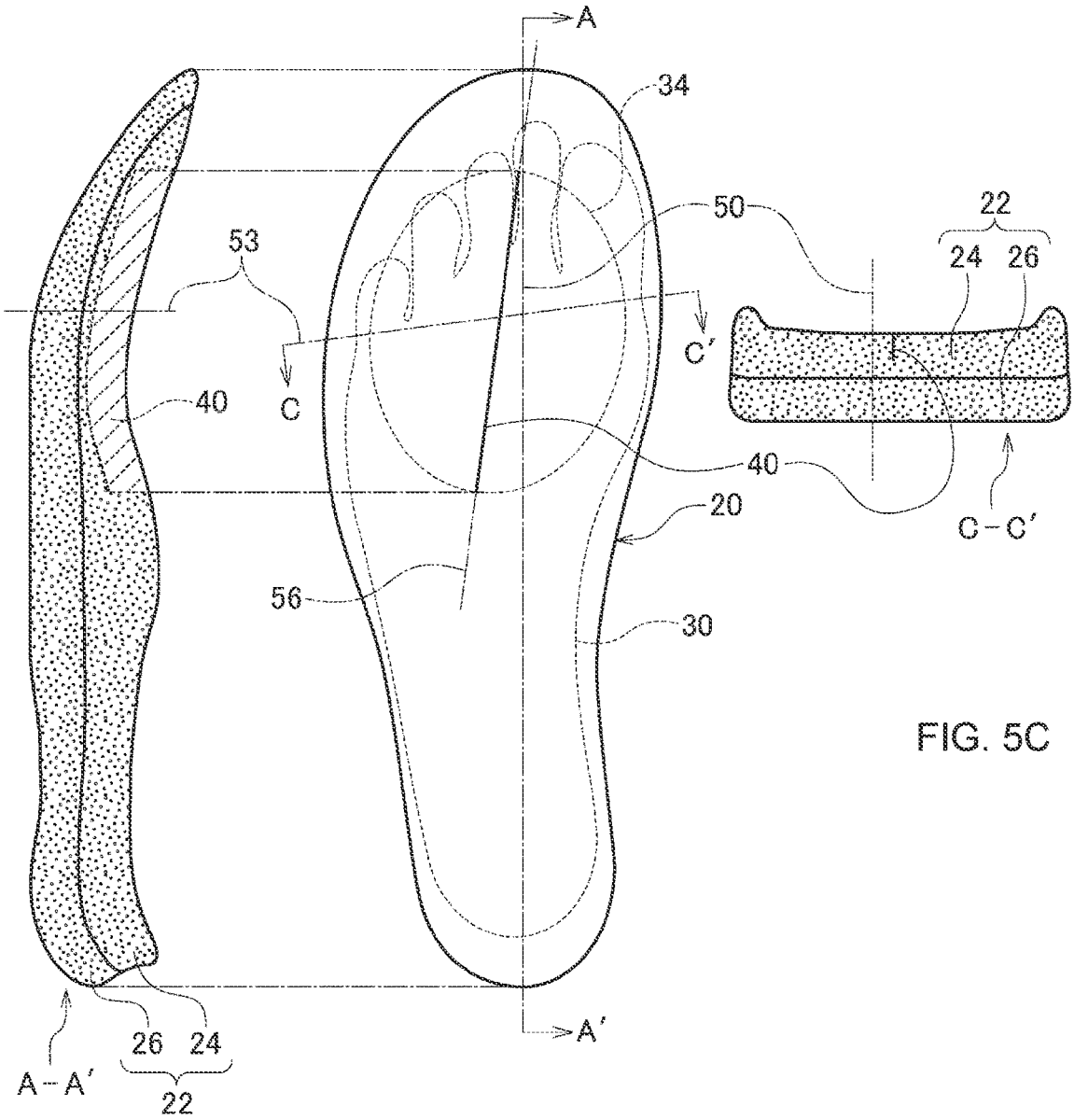

FIGS. 5A-5C a top view and end views of cut sections that schematically show the midsole 22 in the second embodiment. In the top view shown in the middle of FIGS. 5A-5C, a forefoot region 34 that corresponds to a wearer's forefoot portion is indicated by a dotted line. Also, a forefoot axis line 56 that connects the center of the toe and the center of the midfoot portion is indicated by a dashed dotted line.

The forefoot axis line 56 is not parallel to the first cutting plane line 50 and is located at an angle to the first cutting plane line 50 on the lateral side, i.e., an angle inclined to the lateral side based on the toe. The forefoot region 34 is elliptic in shape with its major axis aligned with the forefoot axis line 56, and at least one linear cut 40 is provided along the major axis. As described previously, the shape of the forefoot region 34 where the cut 40 is provided is not limited to an ellipse.

The number of cut 40 provided in the present embodiment is also one. Also, the cut 40 in the present embodiment is formed linearly in top view and configured to have a shape in which part of the cut has no contact point with other part of the cut. In other words, part of the cut does not form a loop due to intersection or contact with other part of the cut.

An end view of the A-A' cut section taken along the first cutting plane line 50 is illustrated on the left. Also, an end view of the C-C' cut section taken along line C-C', which connects a slightly posterior position on the lateral side and a slightly anterior position on the medial side in the forefoot region 34, is illustrated on the right. In the end view of the A-A' cut section, although the cut 40 itself does not appear on the end surface, the position where the cut 40 is projected is indicated by dotted diagonal lines. The depth of the cut 40 is less than half the thickness of the midsole 22, such as about one-third the thickness of the midsole 22. In the end view of the C-C' cut section, the cut 40 is shown at a position slightly shifted from the first cutting plane line 50 to the lateral side.

In the present embodiment, one cut 40 is provided in a foot length direction in the forefoot region 34, so that, when a load is applied in the medial direction or the lateral direction at the time of landing, for example, shear deformation of the midsole 22, with the cut 40 as a boundary, can be promoted. This can further improve the impact buffering properties, compared to the midsole 22 without the cut 40.

In a modification, one linear cut 40 can be provided along a direction other than the foot length directions in the forefoot region 34. For example, in the case where the cut 40 is provided in a foot width direction along a third cutting plane line 53 shown in FIGS. 5A-5C, shear deformation of the midsole 22 with the cut 40 as a boundary can be promoted when a load is applied from the rear side to the front side in forefoot landing or when a load is applied from the front side to the rear side at the time of pushing off. This can further improve the impact buffering properties, compared to the midsole 22 without the cut 40. Also, two or more linear cuts 40, which do not intersect each other, can be provided in the forefoot region 34. In the following, a modification in which two non-intersecting cuts are provided will be described. However, in another modification, three or more non-intersecting cuts can be provided.

Figure 6A:
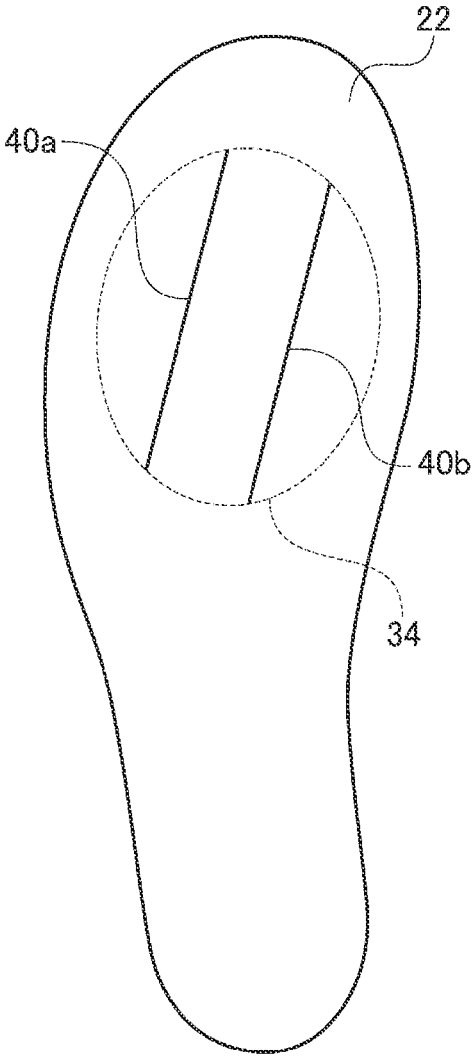
FIGS. 6A and 6B are top views that schematically show the positions of cuts in first and second modifications of the second embodiment.
Figure 6B:
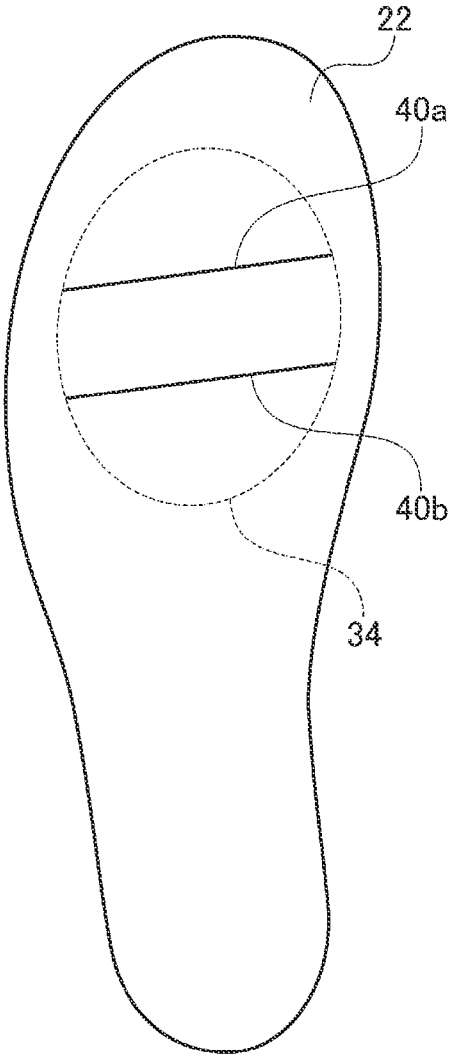

FIGS. 6A and 6B are top views that schematically show the positions of cuts in first and second modifications of the second embodiment. In the modifications of FIGS. 6, two cuts are provided in various modes in the forefoot region 34 of the midsole 22.

In the first modification shown in FIG. 6A, two cuts (a first cut 40*a* and a second cut 40*b*) parallel to the major axis of the forefoot region 34 are provided. The first cut 40*a* and the second cut 40*b* need not be parallel, as long as they do not intersect each other.

The first cut 40*a* is formed linearly in top view and configured to have a shape in which part of the cut has no contact point with other part of the cut. In other words, part of the cut does not form a loop due to intersection or contact with other part of the cut.

The second cut 40*b* is also formed linearly in top view and configured to have a shape in which part of the cut has no contact point with other part of the cut. In other words, part of the cut does not form a loop due to intersection or contact with other part of the cut.

In the first modification of the second embodiment, the two cuts 40 are provided in a foot length direction in the forefoot region 34, so that, when a load is applied in the medial direction or the lateral direction at the time of landing, for example, shear deformation of the midsole 22 can be further promoted, compared to the case where a single cut is provided. Therefore, the impact buffering properties can be further improved.

In the second modification shown in FIG. 6B, two cuts (a first cut 40*a* and a second cut 40*b*) are provided in parallel along an axis line that connects a slightly posterior position on the lateral side and a slightly anterior position on the medial side in the forefoot region 34. The first cut 40*a* and the second cut 40*b* need not be parallel, as long as they do not intersect each other.

The first cut 40*a* is formed linearly in top view and configured to have a shape in which part of the cut has no contact point with other part of the cut. In other words, part of the cut does not form a loop due to intersection or contact with other part of the cut.

The second cut 40*b* is also formed linearly in top view and configured to have a shape in which part of the cut has no contact point with other part of the cut. In other words, part of the cut does not form a loop due to intersection or contact with other part of the cut.

In the second modification of the second embodiment, the two cuts 40 are provided in a foot width direction in the forefoot region 34, so that, when a load is applied from the rear side to the front side at the time of landing, for example, shear deformation of the midsole 22 can be further promoted, compared to the case where a single cut is provided.

Therefore, the impact buffering properties can be further improved.

Third Embodiment

In the present embodiment, multiple intersecting linear cuts 40 are provided, which differs from the first and second embodiments in which non-intersecting cuts 40 are provided. In the following, description will be given mainly for the differences from the first and second embodiments, and the explanation of features in common will be omitted.

Figures 7, 7A, 7B, 7C:
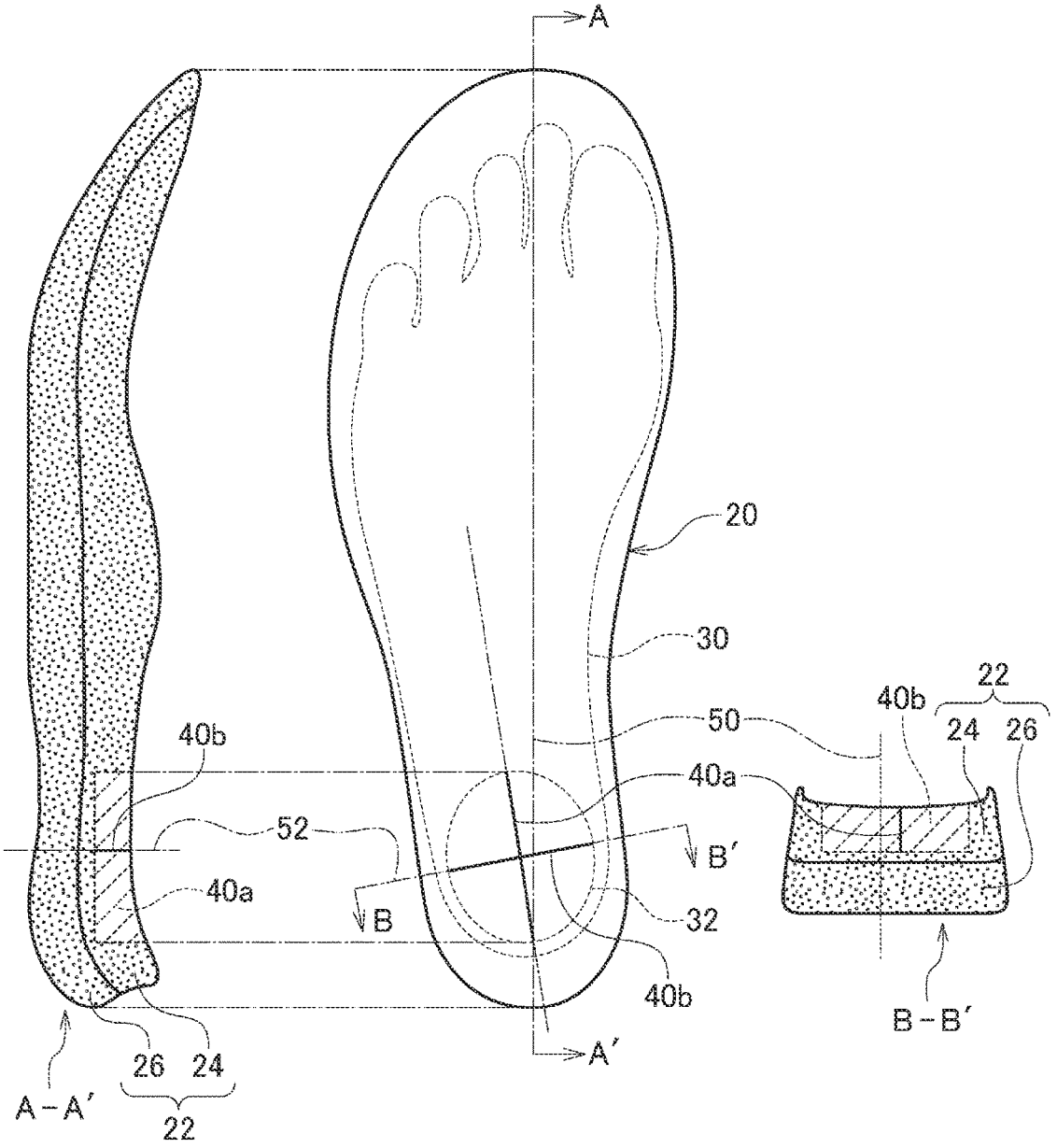
FIGS. 7A-7C illustrate a top view and end views of cut sections that schematically show a midsole in a third embodiment.

FIGS. 7A-7C illustrates a top view and end views of cut sections that schematically show the midsole 22 in the third embodiment. The number of cuts 40 provided in the present embodiment is two. A first cut 40*a* of linear shape is provided along the major axis of the heel region 32, and a second cut 40*b* of linear shape is further provided along the minor axis of the heel region 32. The first cut 40*a* and the second cut 40*b* are each formed linearly in top view and intersect each other at the center of the heel region 32.

An end view of the A-A' cut section taken along the first cutting plane line 50 is illustrated on the left. Also, an end view of the B-B' cut section taken along the minor axis of the heel region 32 is illustrated on the right. In the end view of the A-A' cut section, the second cut 40*b* is illustrated at the position of the second cutting plane line 52; although the first cut 40*a* itself does not appear on the end surface, the position where the first cut 40*a* is projected is indicated by dotted diagonal lines. In the end view of the B-B' cut section, the first cut 40*a* is illustrated at a position slightly shifted from the first cutting plane line 50 to the lateral side; although the second cut 40*b* itself does not appear on the end surface, the position where the second cut 40*b* is projected is indicated by dotted diagonal lines.

In the present embodiment, one first cut 40*a* is provided in a foot length direction in the heel region 32, so that, when a load is applied in the medial direction or the lateral direction at the time of landing, for example, shear deformation of the midsole 22, with the first cut 40*a* as a boundary, can be promoted. Also, one second cut 40*b* is provided in a foot width direction in the heel region 32, so that, when a load is applied from the rear side to the front side in heel landing, for example, shear deformation of the midsole 22 with the second cut 40*b* as a boundary can be promoted. This can further improve the impact buffering properties, compared to the midsole 22 without a cut 40.

Figure 8A:
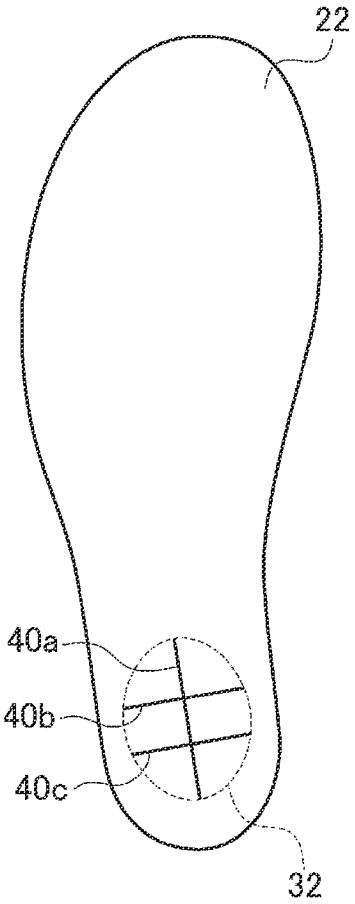
FIGS. 8A-8D are top views that schematically show the positions of cuts in first through fourth modifications of the third embodiment.
Figure 8B:
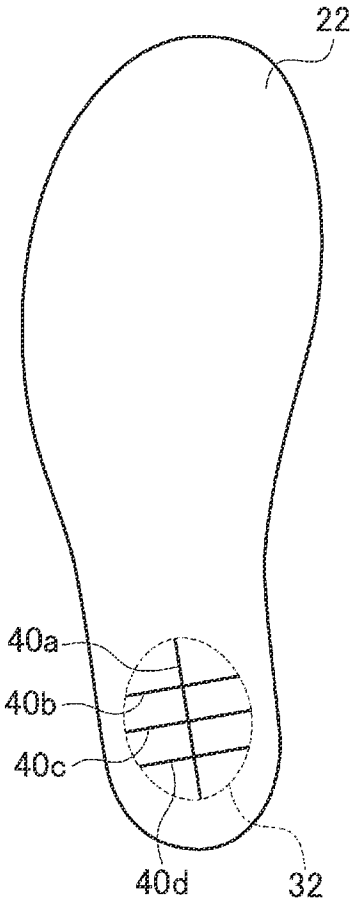

FIGS. 8A and 8B are top views that schematically show the positions of cuts in first through fourth modifications of the third embodiment. In the modifications of FIGS. 8, three to four cuts are provided in various modes in the heel region 32 of the midsole 22.

In the first modification shown in FIG. 8A, one cut (a first cut 40*a*) along the major axis of the heel region 32 and two cuts (a second cut 40*b* and a third cut 40*c*) parallel to the minor axis of the heel region 32 are provided such that the first cut 40*a* intersects the second cut 40*b* and the third cut 40*c*. The second cut 40*b* and the third cut 40*c* need not be parallel, as long as they do not intersect each other.

In the first modification, two cuts 40 are provided in a foot width direction in the heel region 32, so that, when a load is applied from the rear side to the front side in heel landing, for example, shear deformation of the midsole 22 can be further promoted, compared to the case where a single cut is provided. Therefore, the impact buffering properties can be further improved.

In the second modification shown in FIG. 8B, one cut (a first cut 40*a*) along the major axis of the heel region 32 and three cuts (a second cut 40*b*, a third cut 40*c*, and a fourth cut 40*d*) parallel to the minor axis of the heel region 32 are provided such that the first cut 40*a* intersects the second cut 40*b*, the third cut 40*c*, and the fourth cut 40*d*. The second cut 40*b*, the third cut 40*c*, and the fourth cut 40*d* need not be parallel, as long as they do not intersect each other.

In the second modification, three cuts 40 are provided in a foot width direction in the heel region 32, so that, when a load is applied from the rear side to the front side in heel landing, for example, shear deformation of the midsole 22 can be further promoted, compared to the case where one or two cuts are provided. Therefore, the impact buffering properties can be further improved.

Figure 8C:
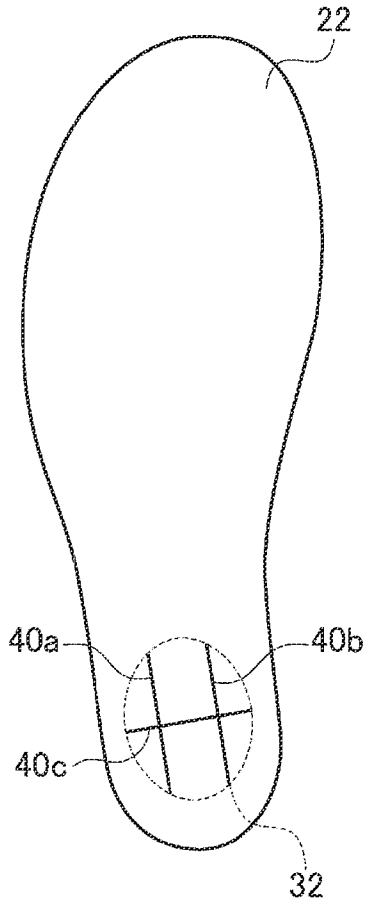

In the third modification shown in FIG. 8C, two cuts (a first cut 40*a* and a second cut 40*b*) parallel to the major axis of the heel region 32 and one cut (a third cut 40*c*) along the minor axis of the heel region 32 are provided such that the first cut 40*a* and the second cut 40*b* intersect the third cut 40*c*. The first cut 40*a* and the second cut 40*b* need not be parallel, as long as they do not intersect each other.

In the third modification, two cuts 40 are provided in a foot length direction in the heel region 32, so that, when a load is applied in the medial direction or the lateral direction at the time of landing, for example, shear deformation of the midsole 22 can be further promoted, compared to the case where a single cut is provided. Therefore, the impact buffering properties can be further improved.

Figure 8D:
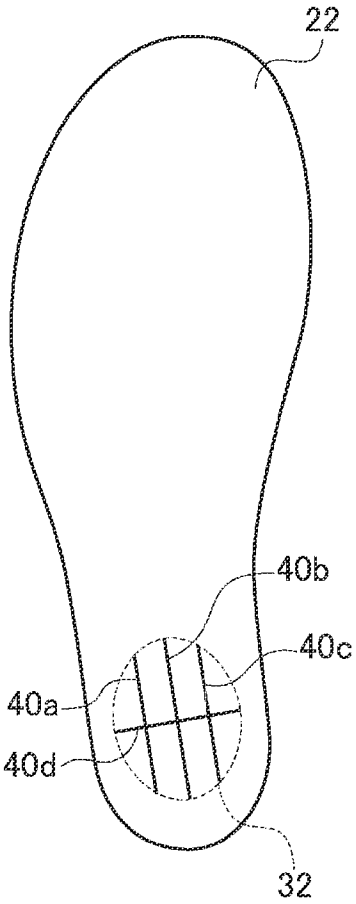

In the fourth modification shown in FIG. 8D, three cuts (a first cut 40*a*, a second cut 40*b*, and a third cut 40*c*) parallel to the major axis of the heel region 32 and one cut (a fourth cut 40*d*) along the minor axis of the heel region 32 are provided such that the first cut 40*a*, the second cut 40*b*, and the third cut 40*c* intersect the fourth cut 40*d*. The first cut 40*a*, the second cut 40*b*, and the third cut 40*c* need not be parallel, as long as they do not intersect each other.

In the fourth modification, three cuts 40 are provided in a foot length direction in the heel region 32, so that, when a load is applied in the medial direction or the lateral direction at the time of landing, for example, shear deformation of the midsole 22 can be further promoted, compared to the case where one or two cuts are provided. Therefore, the impact buffering properties can be further improved.

Fourth Embodiment

In the present embodiment, multiple intersecting linear cuts 40 are provided in the forefoot region, which differs from the first and second embodiments in which non-intersecting cuts 40 are provided or the third embodiment in which intersecting cuts 40 are provided in the heel region. In the following, description will be given mainly for the differences from the first through third embodiments, and the explanation of features in common will be omitted.

Figures 9, 9A, 9B, 9C:
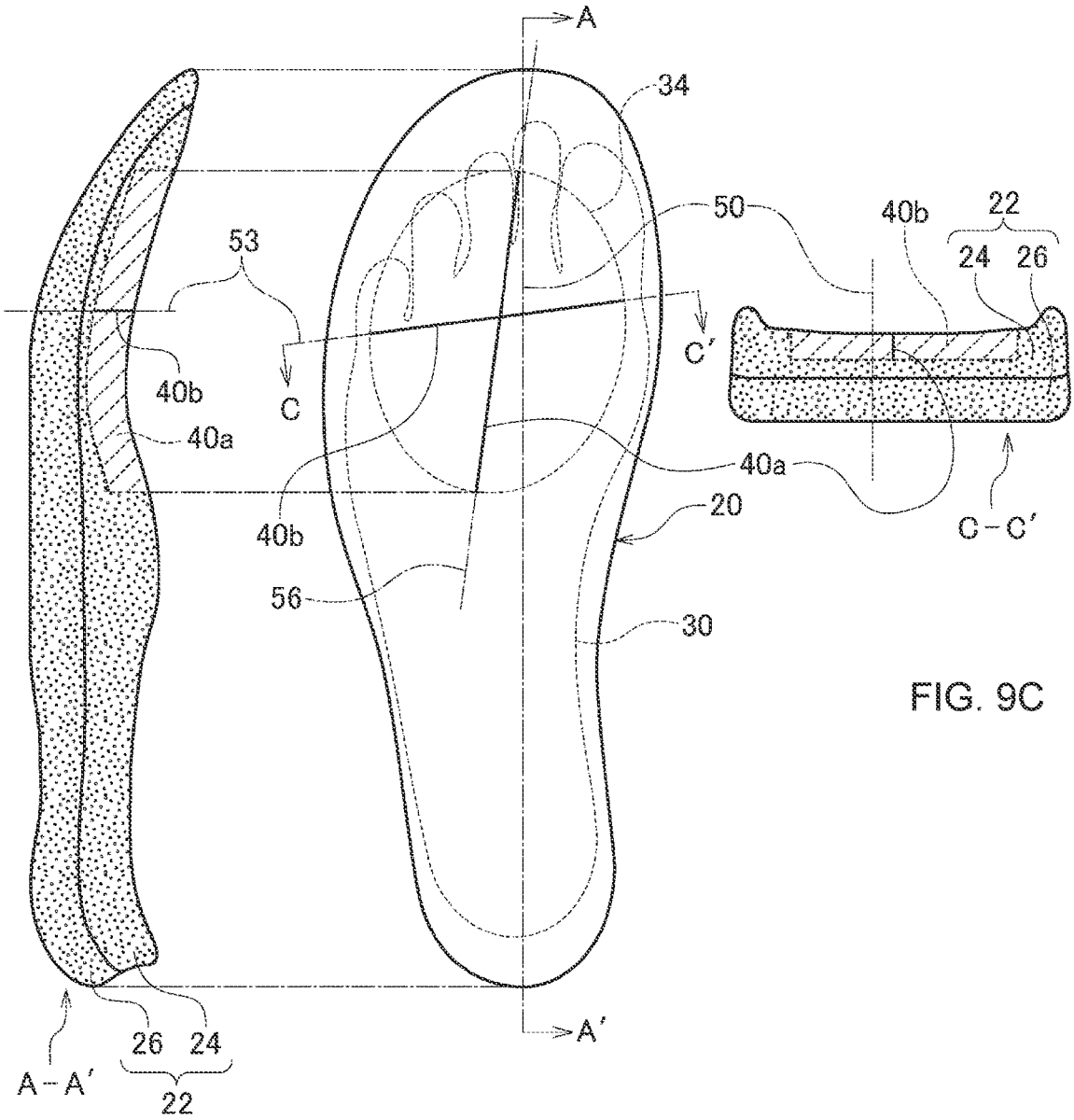
FIGS. 9A-9C illustrate a top view and end views of cut sections that schematically show a midsole in a fourth embodiment.

FIGS. 9A-9C illustrate a top view and end views of cut sections that schematically show the midsole 22 in the fourth embodiment. The number of cuts 40 provided in the present embodiment is two. A first cut 40*a* of linear shape is provided along the major axis of the forefoot region 34, and a second cut 40*b* of linear shape is further provided along an axis line that connects a slightly posterior position on the lateral side and a slightly anterior position on the medial side in the forefoot region 34. Each cut 40 in the present embodiment is formed linearly in top view and configured to have a shape in which part of the cut has no contact point with other part of the cut. In other words, part of the cut does not form a loop due to intersection or contact with other part of the cut.

An end view of the A-A' cut section taken along the first cutting plane line 50 is illustrated on the left. Also, an end view of the C-C' cut section taken along line C-C', which connects a slightly posterior position on the lateral side and a slightly anterior position on the medial side in the forefoot region 34, is illustrated on the right. In the end view of the A-A' cut section, the second cut 40*b* is illustrated at the position of the third cutting plane line 53; although the first cut 40*a* itself does not appear on the end surface, the position where the first cut 40*a* is projected is indicated by dotted diagonal lines. In the end view of the C-C' cut section, the first cut 40*a* is illustrated at a position slightly shifted from the first cutting plane line 50 to the lateral side; although the second cut 40*b* itself does not appear on the end surface, the position where the second cut 40*b* is projected is indicated by dotted diagonal lines.

In the present embodiment, one first cut 40*a* is provided in a foot length direction in the forefoot region 34, so that, when a load is applied in the medial direction or the lateral direction at the time of landing, for example, shear deformation of the midsole 22, with the first cut 40*a* as a boundary, can be promoted. Also, one second cut 40*b* is provided in a foot width direction in the forefoot region 34, so that, when a load is applied from the rear side to the front side in forefoot landing or when a load is applied from the front side to the rear side at the time of pushing off, for example, shear deformation of the midsole 22 with the second cut 40*b* as a boundary can be promoted. This can further improve the impact buffering properties, compared to the midsole 22 without a cut 40.

FIGS. 10A-10D are top views that schematically show the positions of cuts in first through fourth modifications of the fourth embodiment. In the modifications of FIGS. 10, three to four cuts are provided in various modes in the forefoot region 34 of the midsole 22.

Figure 10A:
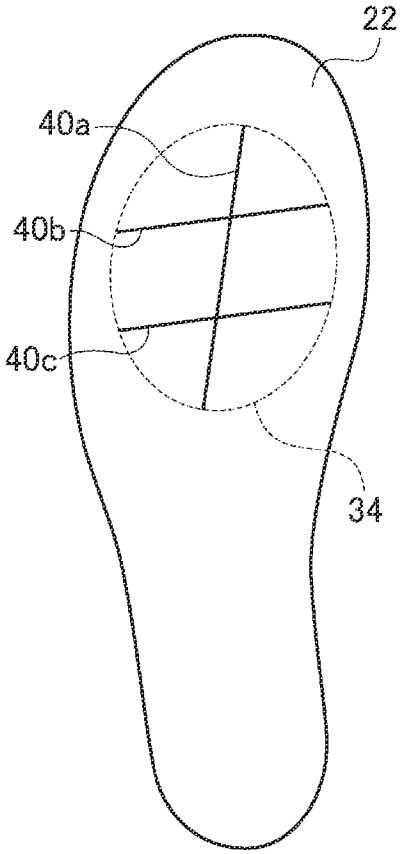
FIGS. 10A-10D are top views that schematically show the positions of cuts in first through fourth modifications of the fourth embodiment.

In the first modification shown in FIG. 10A, one cut (a first cut 40*a*) along the major axis of the forefoot region 34 and two cuts (a second cut 40*b* and a third cut 40*c*) parallel to a foot width direction in the forefoot region 34 are provided such that the first cut 40*a* intersects the second cut 40*b* and the third cut 40*c*. The second cut 40*b* and the third cut 40*c* need not be parallel, as long as they do not intersect each other.

In the first modification, two cuts 40 are provided in a foot width direction in the forefoot region 34, so that, when a load is applied from the rear side to the front side at the time of landing, for example, shear deformation of the midsole 22 can be further promoted, compared to the case where a single cut is provided. Therefore, the impact buffering properties can be further improved.

Figure 10B:
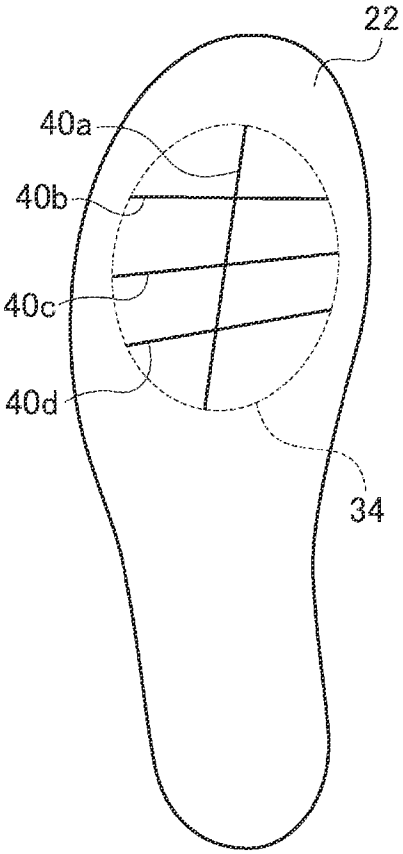

In the second modification shown in FIG. 10B, one cut (a first cut 40*a*) along the major axis of the forefoot region 34 and three cuts (a second cut 40*b*, a third cut 40*c*, and a fourth cut 40*d*) parallel to a foot width direction in the forefoot region 34 are provided such that the first cut 40*a* intersects the second cut 40*b*, the third cut 40*c*, and the fourth cut 40*d*. The second cut 40*b*, the third cut 40*c*, and the fourth cut 40*d* need not be parallel, as long as they do not intersect each other.

In the second modification, three cuts 40 are provided in a foot width direction in the forefoot region 34, so that, when a load is applied from the rear side to the front side at the time of landing, for example, shear deformation of the midsole 22 can be further promoted, compared to the case where one or two cuts are provided. Therefore, the impact buffering properties can be further improved.

Figure 10C:
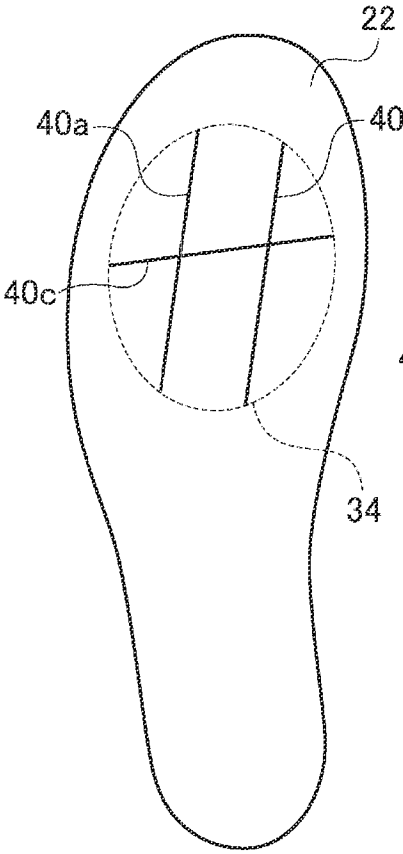

In the third modification shown in FIG. 10C, two cuts (a first cut 40*a* and a second cut 40*b*) parallel to the major axis of the forefoot region 34 and one cut (a third cut 40*c*) in a foot width direction in the forefoot region 34 are provided such that the first cut 40*a* and the second cut 40*b* intersect the third cut 40*c*.

In the third modification, two cuts 40 are provided in a foot length direction in the forefoot region 34, so that, when a load is applied in the medial direction or the lateral direction at the time of landing, for example, shear deformation of the midsole 22 can be further promoted, compared to the case where a single cut is provided. Therefore, the impact buffering properties can be further improved.

Figure 10D:
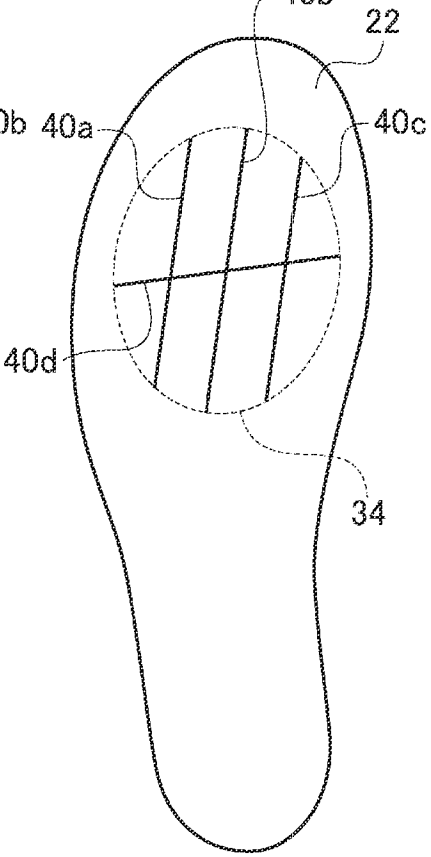

In the fourth modification shown in FIG. 10D, three cuts (a first cut 40*a*, a second cut 40*b*, and a third cut 40*c*) parallel to the major axis of the forefoot region 34 and one cut (a fourth cut 40*d*) in a foot width direction in the forefoot region 34 are provided such that the first cut 40*a*, the second cut 40*b*, and the third cut 40*c* intersect the fourth cut 40*d*.

In the fourth modification, three cuts 40 are provided in a foot length direction in the forefoot region 34, so that, when a load is applied in the medial direction or the lateral direction at the time of landing, for example, shear deformation of the midsole 22 can be further promoted, compared to the case where one or two cuts are provided. Therefore, the impact buffering properties can be further improved.

Fifth Embodiment

In the present embodiment, a cut 40 is provided on the lower surface of the midsole 22, which differs from the first through fourth embodiments in which a cut 40 is provided on the upper surface of the midsole 22. In the following, description will be given mainly for the differences from the first through fourth embodiments, and the explanation of features in common will be omitted.

Figure 11A:
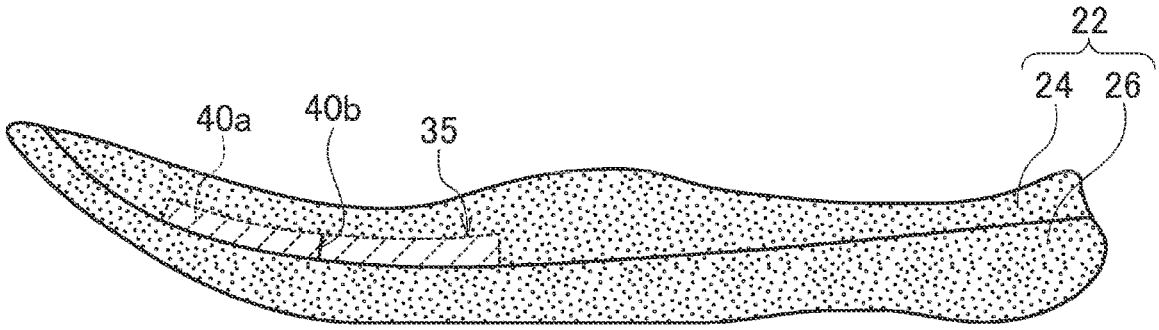
FIGS. 11A and 11B are end views that schematically show a cut region in a fifth embodiment.
Figure 11B:
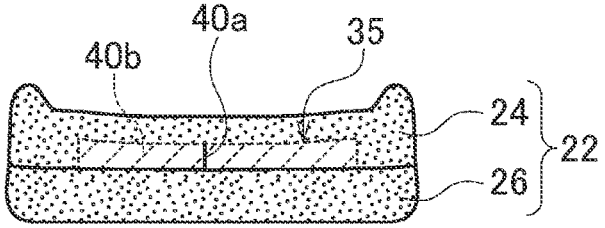

FIGS. 11A and 11B are end views that schematically show a cut region in the fifth embodiment. FIG. 11A is an end view of the midsole 22 in a foot length direction, and FIG. 11B is an end view of the midsole 22 in a foot width direction. A cut region 35 is provided on the lower surface of the midsole 22, i.e., on the surface side bonded to the outsole 28. In this case, the impact buffering properties for the case of running on irregular ground or uneven road surfaces, for example, can be improved. As is the case in the first through fourth embodiments, there are multiple modes with regard to the position, size, shape, incidence angle, depth, number of cuts, and the like of the cut region 35 on the lower surface of the midsole 22.

In the first through fifth embodiments, examples have been described in which a cut is provided on one of the upper surface or the lower surface of the midsole 22. In a modification, cuts can be provided on both the upper surface and the lower surface of the midsole 22. In such a case, there can be multiple modes with regard to the positions of cuts, the size, shape, incidence angle, depth, number of cuts, and the like of the region on each of the upper surface and the lower surface of the midsole 22, and there can be various combinations of the modes of the upper surface and the lower surface.

Sixth Embodiment

In the present embodiment, the midsole 22 is constituted by multiple layers of an upper layer and a lower layer, and a cut 40 is provided on at least one of the upper surface of the upper layer, the lower surface of the upper layer, the upper surface of the lower layer, or the lower surface of the lower layer, which differs from the first through fifth embodiments in which a cut 40 is provided on the upper surface or the lower surface of the midsole 22 constituted by a single layer. In the following, description will be given mainly for the differences from the first through fifth embodiments, and the explanation of features in common will be omitted.

Figure 12A:
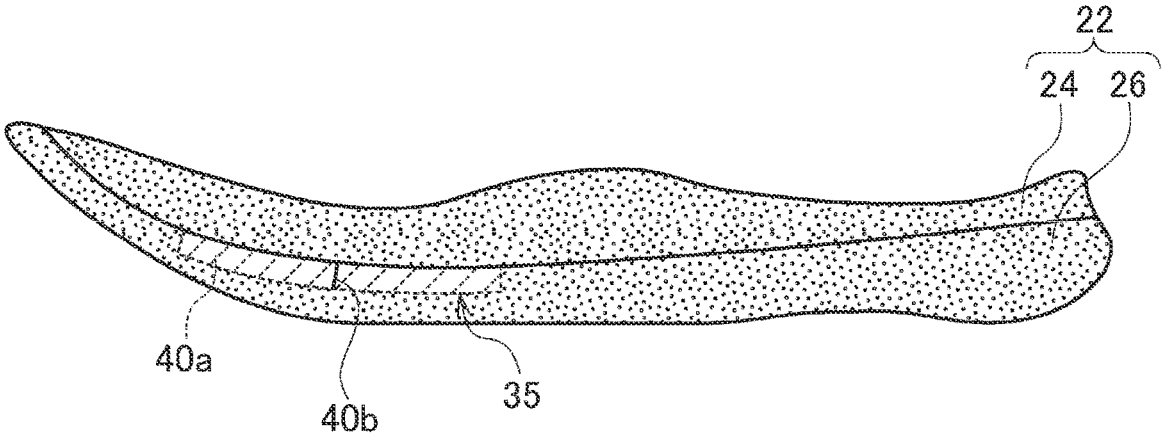
FIG. 12 is a perspective view of a shoe according to a sixth embodiment, viewed obliquely from the front left side.
Figure 12B:
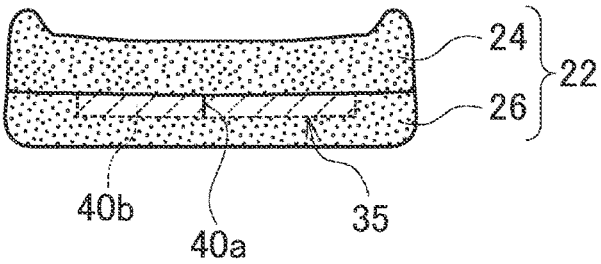

FIG. 12 is a perspective view of a shoe according to the sixth embodiment, viewed obliquely from the front left side. The midsole 22 of the present embodiment is constituted by multiple layers of a first layer 24, which is a sponge member as an upper layer, and a second layer 26, which is also a sponge member as a lower layer, laminated and bonded together. The midsole 22 can also be configured such that, between the first layer 24 and the second layer 26, a plate member made of a carbon fiber material or the like, not illustrated, is provided to improve the repulsion.

Figure 13A:
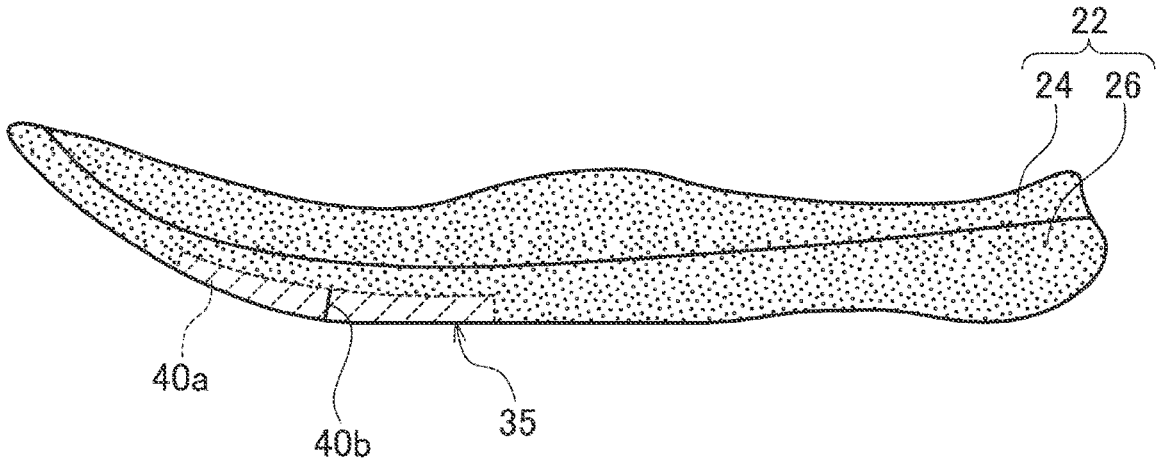
FIGS. 13A and 13B are end views that schematically show a cut region in a first example of the sixth embodiment.
Figure 13B:
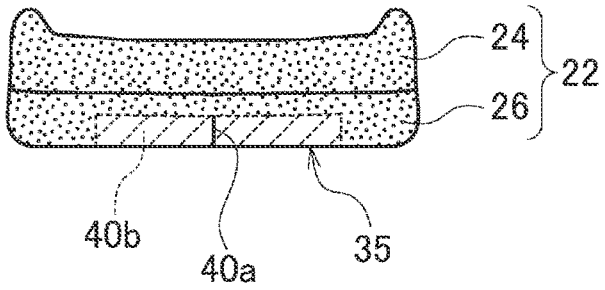

FIGS. 13A and 13B are end views that schematically show a cut region in a first example of the sixth embodiment. FIG. 13A is an end view of the midsole 22 in a foot length direction, and FIG. 13B is an end view of the midsole 22 in a foot width direction. A cut region 35 is provided on the upper surface of the first layer 24, i.e., on the surface side bonded to the inner sole 21. In this case, the impact buffering properties can be improved as is the case in the first through fourth embodiments. Also, as is the case in the first through fifth embodiments, there are multiple modes with regard to the position, size, shape, incidence angle, depth, number of cuts, and the like of the cut region 35 on the upper surface of the first layer 24.

Figure 14:
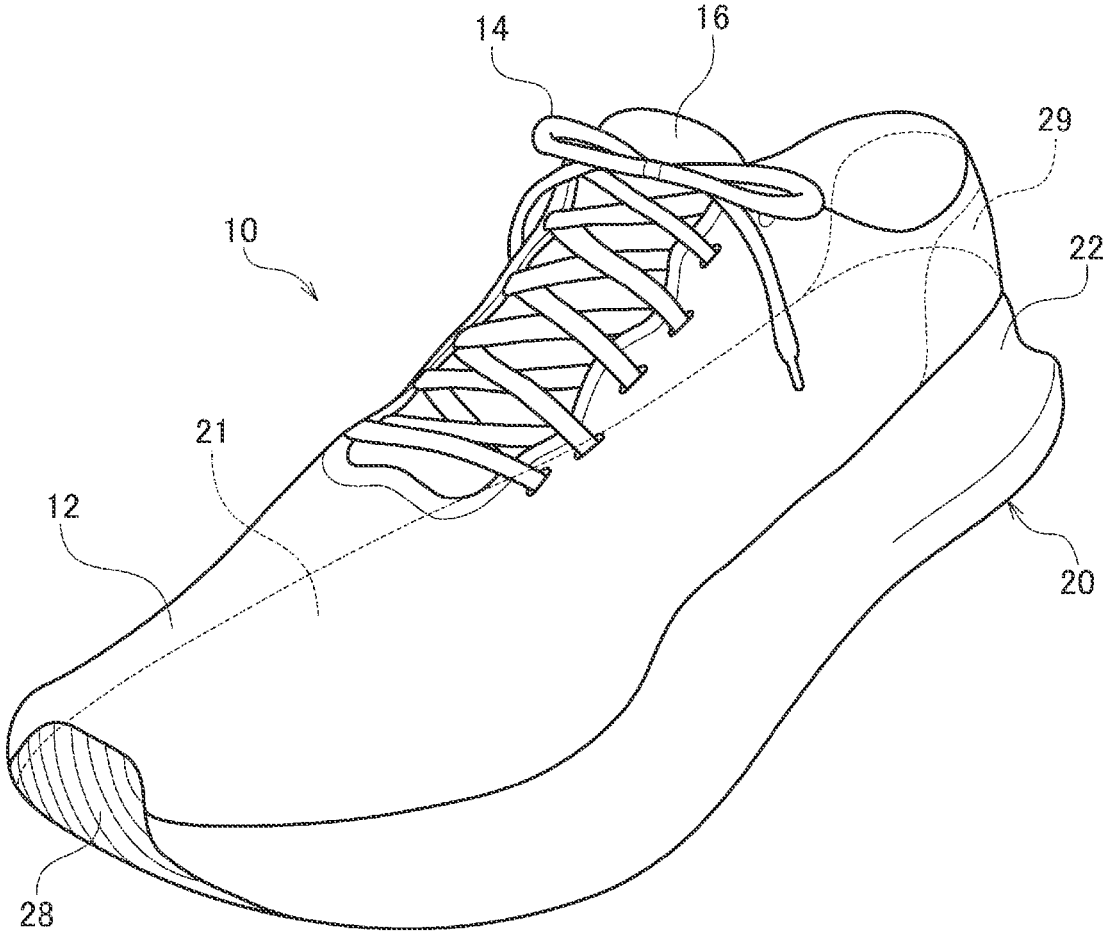
FIGS. 14A and 14B are end views that schematically show a cut region in a second example of the sixth embodiment.

FIGS. 14A and 14B are end views that schematically show a cut region in a second example of the sixth embodiment. FIG. 14A is an end view of the midsole 22 in a foot length direction, and FIG. 14B is an end view of the midsole 22 in a foot width direction. A cut region 35 is provided on the lower surface of the first layer 24, i.e., on the surface side bonded to the upper surface of the second layer 26. In this case, since a cut is provided at a position away from the wearer's sole, the impact buffering properties can be improved without impairing the stability on the sole. Also, as is the case in the first through fifth embodiments, there are multiple modes with regard to the position, size, shape, incidence angle, depth, number of cuts, and the like of the cut region 35 on the lower surface of the first layer 24.

Figure 15A:
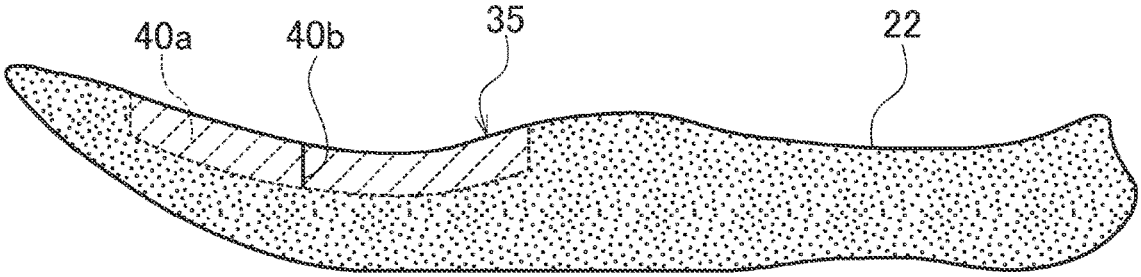
FIGS. 15A and 15B are end views that schematically show a cut region in a third example of the sixth embodiment.
Figure 15B:
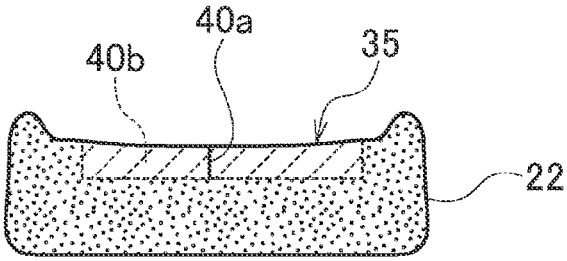

FIGS. 15A and 15B are end views that schematically show a cut region in a third example of the sixth embodiment. FIG. 15A is an end view of the midsole 22 in a foot length direction, and FIG. 15B is an end view of the midsole 22 in a foot width direction. A cut region 35 is provided on the upper surface of the second layer 26, i.e., on the surface side bonded to the lower surface of the first layer 24. In this case, since a cut is provided at a position away from the wearer's sole, the impact buffering properties can be improved without impairing the stability on the sole. Further, when a plate member is provided between the first layer 24 and the second layer 26, deformation immediately beneath the plate, where application is distributed and compressive deformation is difficult, can be facilitated. Also, as is the case in the first through fifth embodiments, there are multiple modes with regard to the position, size, shape, incidence angle, depth, number of cuts, and the like of the cut region 35 on the upper surface of the second layer 26.

Figure 16A:
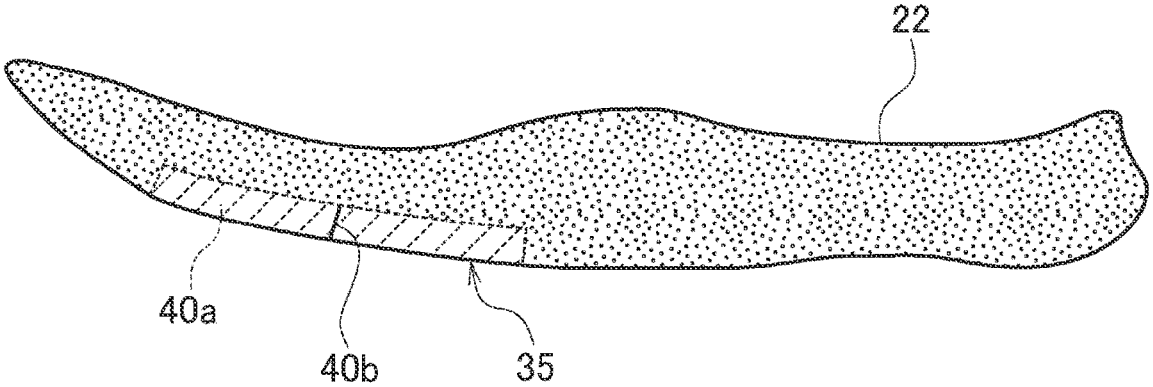
FIGS. 16A and 16B are end views that schematically show a cut region in a fourth example of the sixth embodiment.
Figure 16B:
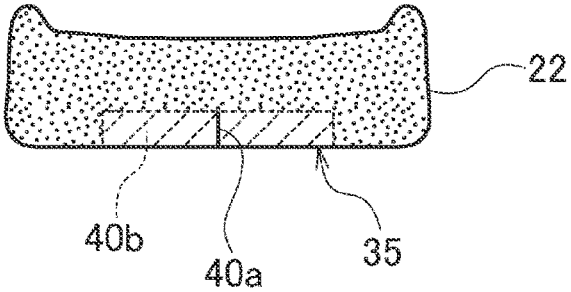

FIGS. 16A and 16B are end views that schematically show a cut region in a fourth example of the sixth embodiment. FIG. 16A is an end view of the midsole 22 in a foot length direction, and FIG. 16B is an end view of the midsole 22 in a foot width direction. A cut region 35 is provided on the lower surface of the second layer 26, i.e., on the surface side bonded to the outsole 28. In this case, since a cut is provided at a position away from the wearer's sole, the impact buffering properties can be improved without impairing the stability on the sole. Further, the impact buffering properties for the case of running on irregular ground or uneven road surfaces, for example, can also be improved. Also, as is the case in the first through fifth embodiments, there are multiple modes with regard to the position, size, shape, incidence angle, depth, number of cuts, and the like of the cut region 35 on the lower surface of the second layer 26.

In the first through fourth examples, examples have been described in which a cut is provided on one of the upper surface of the first layer 24, the lower surface of the first layer 24, the upper surface of the second layer 26, or the lower surface of the second layer 26. In another modification, cuts can be provided on multiple surfaces among the upper surface of the first layer 24, the lower surface of the first layer 24, the upper surface of the second layer 26, and the lower surface of the second layer 26. In such a case, there can be multiple modes with regard to the positions of cuts, the size, shape, incidence angle, depth, number of cuts, and the like of the region on each surface, and there can be various combinations of the modes of the multiple surfaces. Also, the position of a cut is not limited to a position on the upper surface or the lower surface, and, in at least one of the first layer 24 or the second layer 26, a cut can be provided at a depth such as not to appear on a surface or can be provided such as to vertically pierce the layer.

Seventh Embodiment

The present embodiment differs from the first through sixth embodiments in the shape of a region where a cut 40 is provided. In the following, description will be given mainly for the differences from the first through sixth embodiments, and the explanation of features in common will be omitted. The seventh and subsequent embodiments are described mainly using examples in which a cut 40 is provided on the upper surface of the midsole 22 constituted by a single layer, as is the case in the first through fourth embodiments. However, a cut 40 as described below can be provided also on the lower surface of the midsole 22 constituted by a single layer, as is the case in the fifth embodiment, or on at least one of the upper surface of the upper layer, the lower surface of the upper layer, the upper surface of the lower layer, or the lower surface of the lower layer in the midsole 22 constituted by multiple layers, as is the case in the sixth embodiment.

Figure 17A:
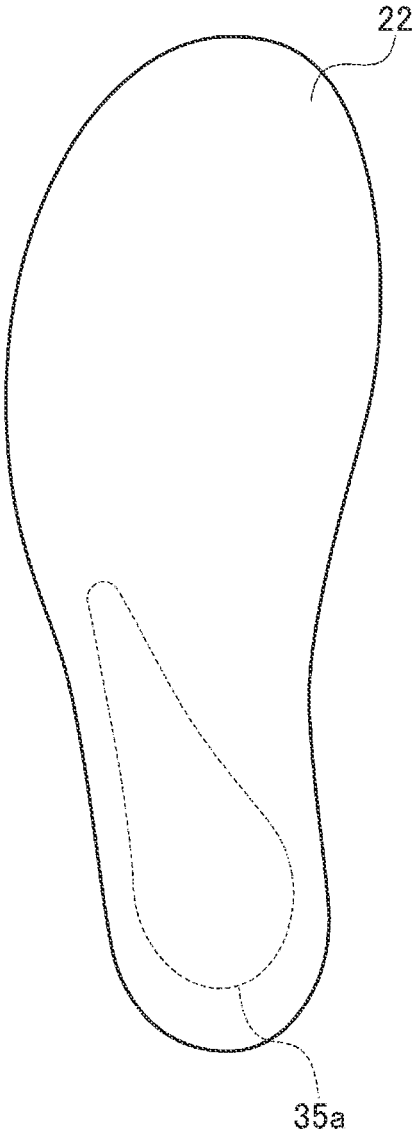
FIGS. 17A and 17B are top views that schematically show the positions of cuts in first and second examples of a seventh embodiment.
Figure 17B:
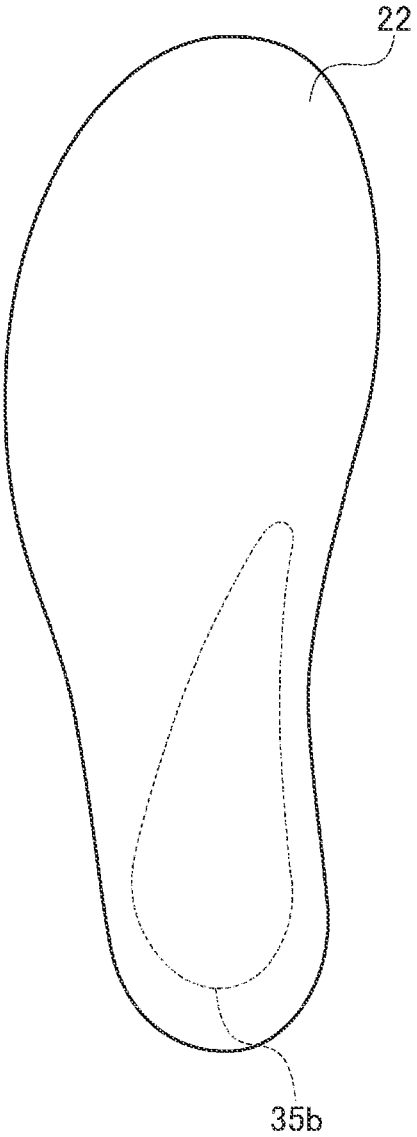

FIGS. 17A and 17B are top views that schematically show the positions of cuts in first and second examples of the seventh embodiment. In the examples of FIGS. 17A and 17B, a cut is provided in various modes, as is the case in the first through sixth embodiments, in a region from a heel portion to the midfoot portion of the midsole 22.

In the first example shown in FIG. 17A, one or more cuts 40 are provided in a cut region 35*a* of fan shape, which extends and tapers off from a region supporting the entire heel toward the lateral side of the midfoot portion. With such a cut 40 provided in an area locally lying in the heel portion and on the lateral side of the midfoot portion, in addition to the effects obtained by providing a cut 40 in the heel portion, the effect of preventing pronation while improving the impact buffering properties at the time of landing can be further expected.

In the second example shown in FIG. 17B, one or more cuts 40 are provided in a cut region 35*b* of fan shape, which extends and tapers off from a region supporting the entire heel toward the medial side of the midfoot portion. With such a cut 40 provided in an area locally lying in the heel portion and on the medial side of the midfoot portion, in addition to the effects obtained by providing a cut 40 in the heel portion, the effect of preventing supination while improving the impact buffering properties at the time of landing can be further expected.

Figure 18A:
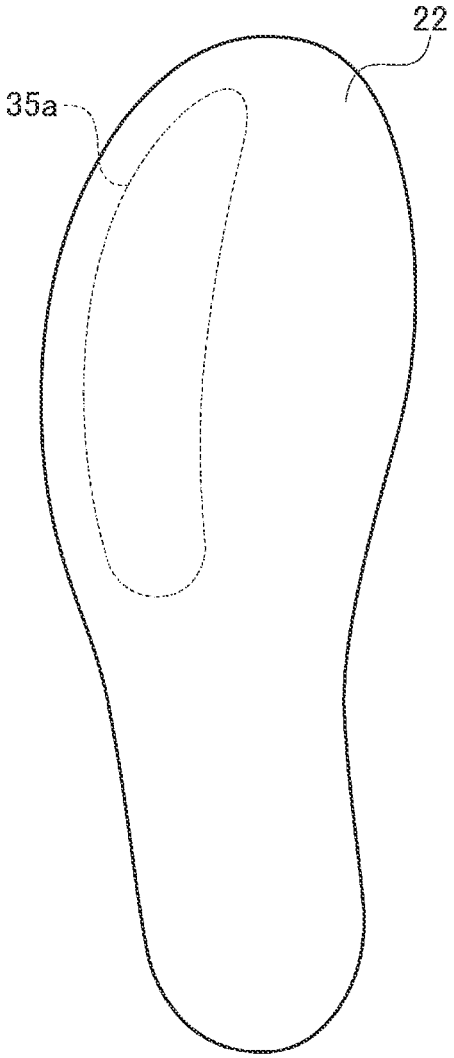
FIGS. 18A and 18B are top views that schematically show the positions of cuts in third and fourth examples of the seventh embodiment.
Figure 18B:
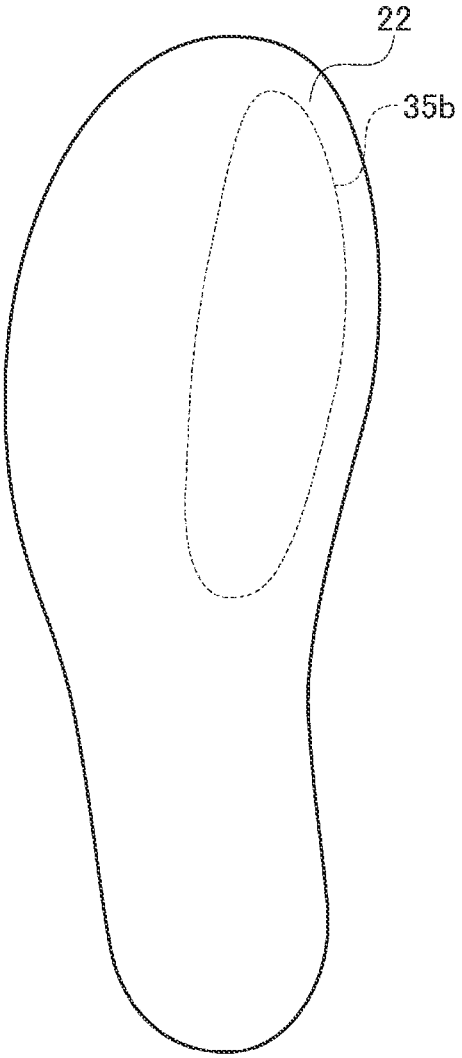

FIGS. 18A and 18B are top views that schematically show the positions of cuts in third and fourth examples of the seventh embodiment. In the examples of FIGS. 18A and 18B, a cut is provided in various modes, as is the case in the first through sixth embodiments, in a region from the forefoot portion to the midfoot portion of the midsole 22.

In the third example shown in FIG. 18A, one or more cuts 40 are provided in a cut region 35*a* supporting a region from the lateral side of the forefoot portion to the lateral side of the midfoot portion. With such a cut 40 provided in an area locally lying on the lateral side of the forefoot portion and the lateral side of the midfoot portion, the impact buffering properties in forefoot landing or midfoot landing can be particularly further improved.

In the fourth example shown in FIG. 18B, one or more cuts 40 are provided in a cut region 35*b* supporting a region from the medial side of the forefoot portion to the medial side of the midfoot portion. With such a cut 40 provided in an area locally lying on the medial side of the forefoot portion and the medial side of the midfoot portion, shear deformation toward the ball of the great toe at the time of pushing off can be particularly further promoted, so that a smooth shift of the center of gravity can be expected.

FIGS. 19A-19D are top views that schematically show the positions of cuts in fifth through eighth examples of the seventh embodiment. In the examples of FIGS. 19A-19D, a cut is provided in various modes, as is the case in the first through sixth embodiments, in a region from the forefoot portion to the midfoot portion of the midsole 22.

Figure 19A:
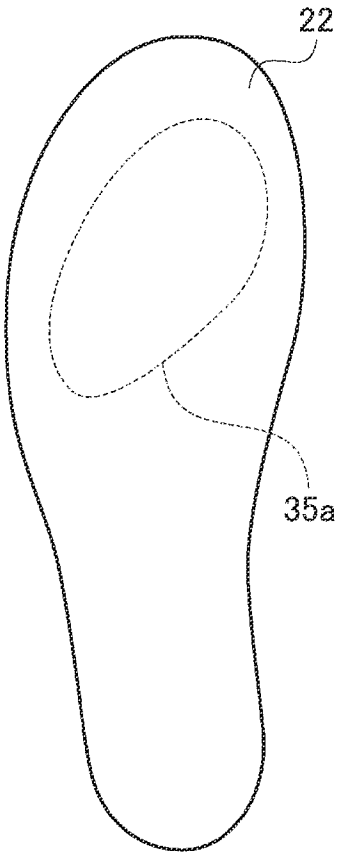
FIGS. 19A-19D are top views that schematically show the positions of cuts in fifth through eighth examples of the seventh embodiment.

In the fifth example shown in FIG. 19A, one or more cuts 40 are provided in a cut region 35*a* extending from a region supporting the entire forefoot portion toward the lateral side of the midfoot portion. With such a cut 40 provided in an area locally lying in the entire forefoot portion and on the lateral side of the midfoot portion, the impact buffering properties in forefoot landing or midfoot landing can be particularly further improved.

Figure 19B:
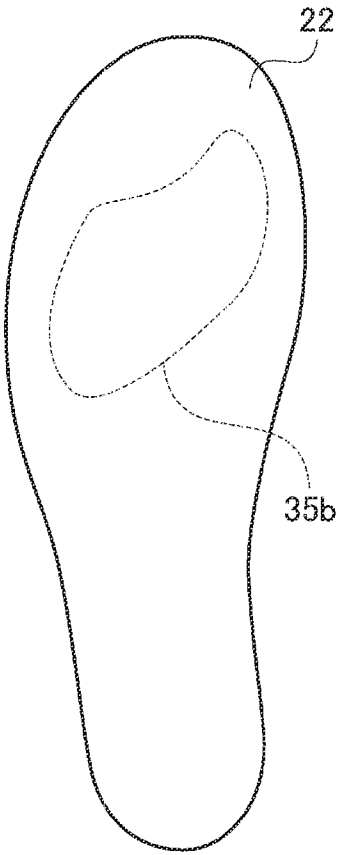

In the sixth example shown in FIG. 19B, one or more cuts 40 are provided in a cut region 35*b*, which is a region where an area on the little toe side is removed from the cut region 35*a* in the fifth example. In this way, by removing the area on the little toe side, where the load is small, the machining range of a cut 40 in the midsole 22 can be reduced, and the manufacturing process can be simplified.

Figure 19C:
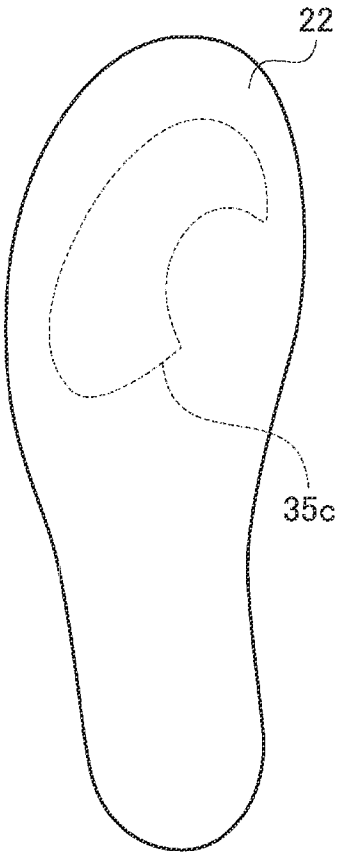

In the seventh example shown in FIG. 19C, one or more cuts 40 are provided in a cut region 35*c*, which is a region where an area around the ball of the great toe is removed from the cut region 35*a* in the fifth example. In this way, by removing the area around the ball of the great toe, where the load at the time of pushing off is large, the stability of pushing off can be further improved, and a separate buffer member can be inserted immediately beneath the ball of the great toe. Also, the machining range of a cut 40 in the midsole 22 can be reduced, and the manufacturing process can be simplified.

Figure 19D:
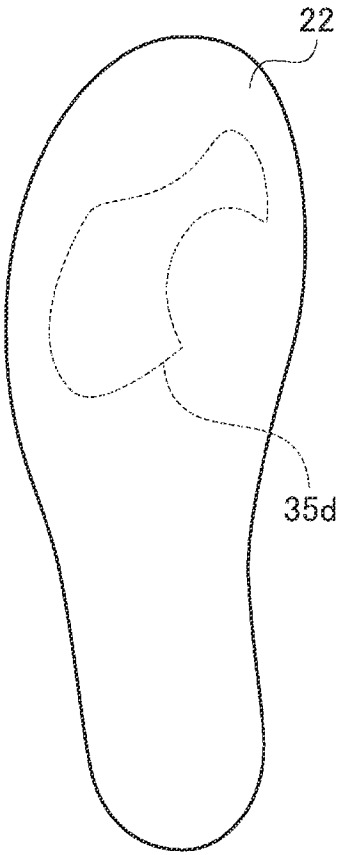

In the eighth example shown in FIG. 19D, one or more cuts 40 are provided in a cut region 35*d*, which is a region where the area on the little toe side and the area around the ball of the great toe are both removed from the cut region 35*a* in the fifth example. In this way, by removing the area on the little toe side where the load is small and the area around the ball of the great toe where the load at the time of pushing off is large, the effects of both the sixth and seventh examples can be obtained.

Eighth Embodiment

The present embodiment differs from the first through seventh embodiments in that the depth of a cut 40 varies depending on the position. In the following, description will be given mainly for the differences from the first through seventh embodiments, and the explanation of features in common will be omitted.

Figures 20, 20A, 20B, 20C:
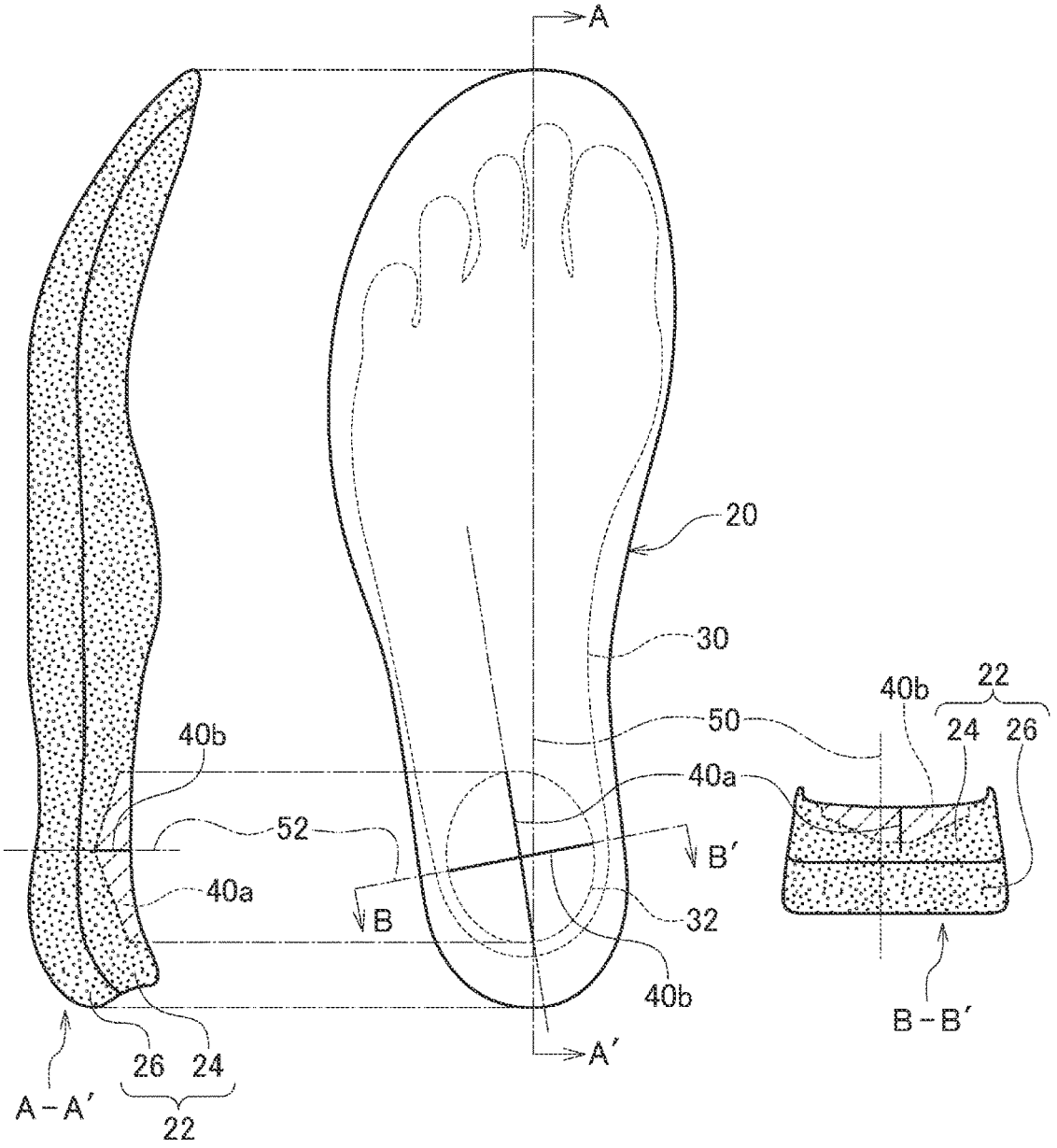
FIGS. 20A-20C illustrate a top view and end views of cut sections that schematically show a midsole in a first example of an eighth embodiment.

FIGS. 20A-20C illustrate a top view and end views of cut sections that schematically show the midsole 22 in a first example of the eighth embodiment. In the example of FIGS. 20A-20C, the depth of a cut 40 varies depending on the position, i.e., depending on the distance to an end of the midsole 22, so that there are a relatively deep part and a relatively shallow part.

With regard to a first cut 40*a*, of which the projected position is indicated by dotted diagonal lines in the end view of the A-A' cut section, the bottom of the first cut 40*a* is sloped such that the first cut 40*a* is shallowest at the front end and the rear end and is deepest at a middle part that intersects a second cut 40*b*. Also, with regard to the second cut 40*b*, of which the projected position is indicated by dotted diagonal lines in the end view of the B-B' cut section, the bottom of the second cut 40*b* is sloped such that the second cut 40*b* is shallowest at the front end and the rear end and is deepest at a middle part that intersects the first cut 40*a*.

A deeper part of a cut 40 can enhance the impact buffering effect, whereas a shallower part thereof can contribute to the stability. By changing the depth of each cut 40 from shallow to deep and to shallow again in a foot length direction or a foot width direction, smooth weight shift can be promoted.

Figures 21, 21A, 21B, 21C:
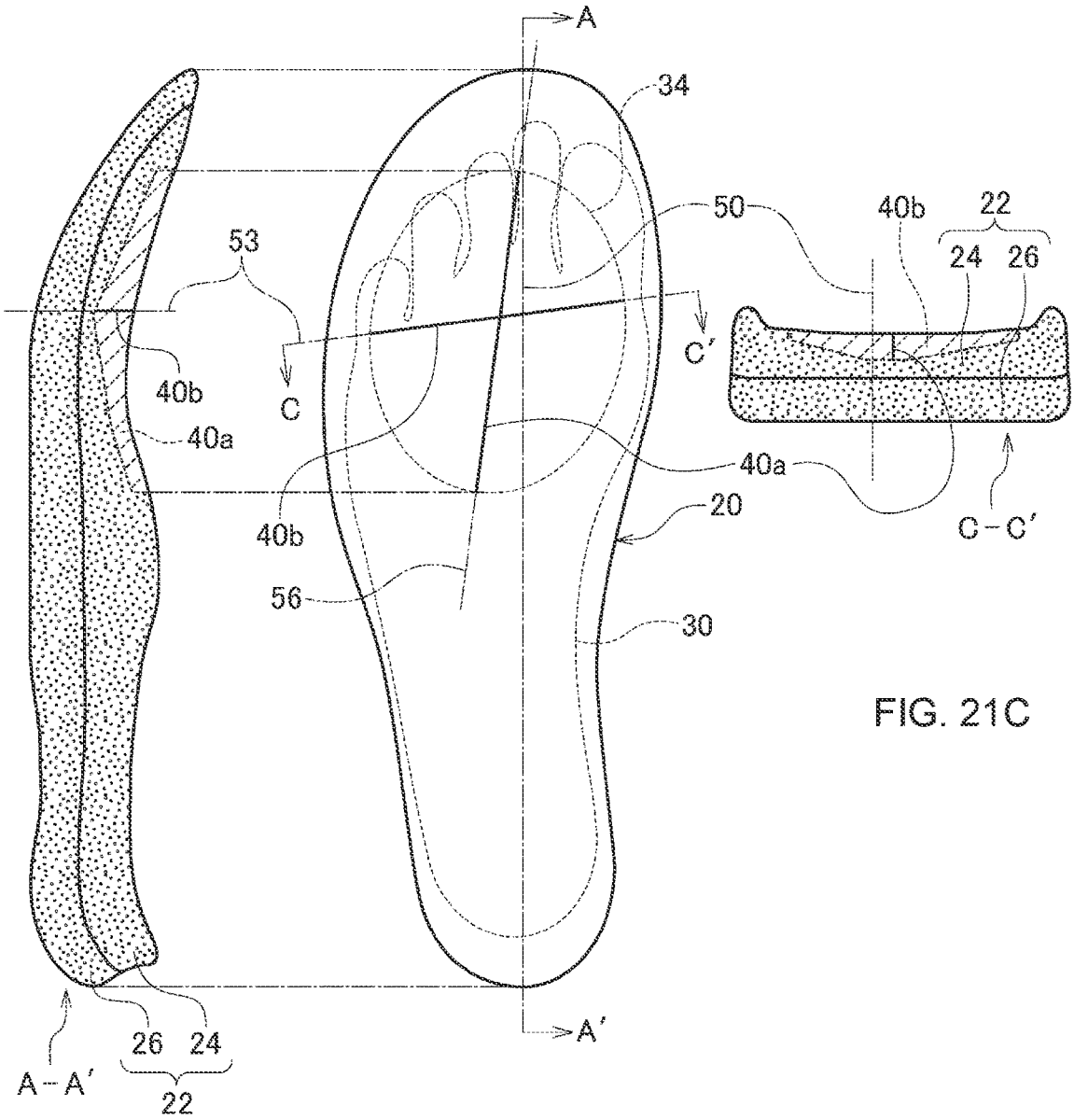
FIGS. 21A-21C illustrate a top view and end views of cut sections that schematically show a midsole in a second example of the eighth embodiment.

FIGS. 21A-21C illustrate a top view and end views of cut sections that schematically show the midsole 22 in a second example of the eighth embodiment. In the example of FIGS. 21A-21C, the depth of a cut 40 varies depending on the position, i.e., depending on the distance to an end of the midsole 22, so that there are a relatively deep part and a relatively shallow part.

With regard to a first cut 40*a*, of which the projected position is indicated by dotted diagonal lines in the end view of the A-A' cut section, the bottom of the first cut 40*a* is sloped such that the first cut 40*a* is shallowest at the front end and the rear end and is deepest at a middle part that intersects a second cut 40*b*. Also, with regard to the second cut 40*b*, of which the projected position is indicated by dotted diagonal lines in the end view of the C-C' cut section, the bottom of the second cut 40*b* is sloped such that the second cut 40*b* is shallowest at the front end and the rear end and is deepest at a middle part that intersects the first cut 40*a*.

A deeper part of a cut 40 can enhance the impact buffering effect, whereas a shallower part thereof can contribute to the stability. By changing the depth of each cut 40 from shallow to deep and to shallow again in a foot length direction or a foot width direction, smooth weight shift can be promoted.

Ninth Embodiment

In the present embodiment, a number of diagonal cuts 40 are provided in stripes in a cut region 35, which differs from the first through eighth embodiments in which one to several cuts 40 are provided in parallel or to intersect. In the following, description will be given mainly for the differences from the first through eighth embodiments, and the explanation of features in common will be omitted.

Figure 22A:
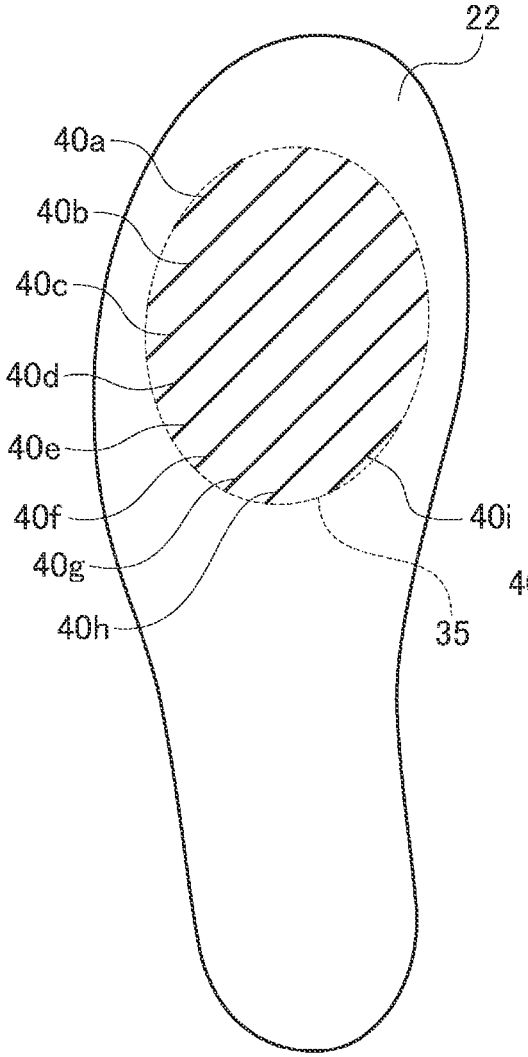
FIGS. 22A and 22B are top views that schematically show the positions of cuts in a ninth embodiment.
Figure 22B:
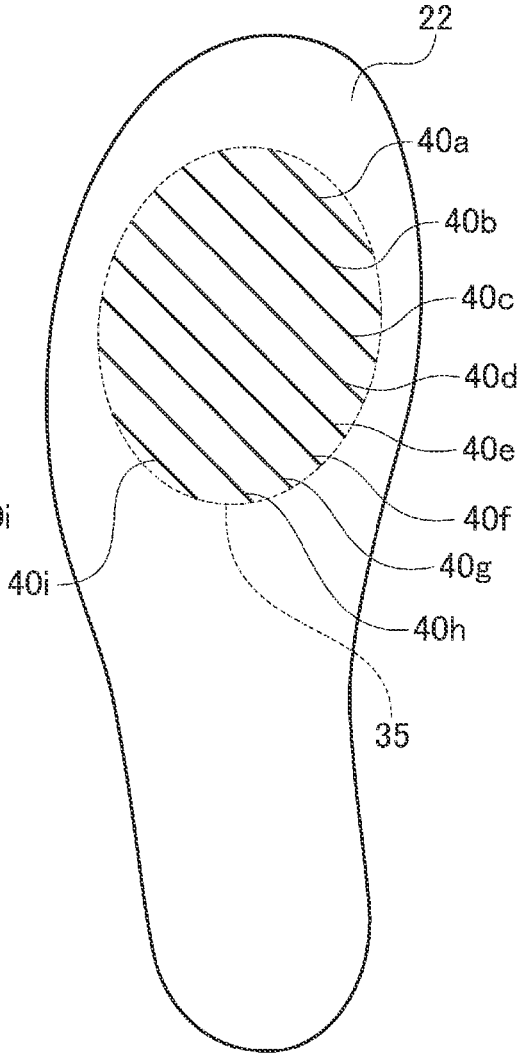

FIGS. 22A and 22B are top views that schematically show the positions of cuts in the ninth embodiment. In the example of FIG. 22A, in the entirety of a cut region 35 of elliptic shape provided in the forefoot portion, nine parallel cuts 40*a*-40*i* are provided in stripes at equal intervals, diagonally from the upper right to the lower left, i.e., from the front medial side to the rear lateral side. In this case, the stability in the diagonal directions of the cuts 40 can be maintained, and, since shear deformation in a direction intersecting the diagonal lines is promoted, medial twisting of the foot can be prevented. As described previously, the shape of the cut region 35 where the cuts 40 are provided is not limited to an ellipse.

In the example of FIG. 22B, in the entirety of a cut region 35 of elliptic shape provided in the forefoot portion, nine parallel cuts 40*a*-40*i* are provided in stripes at equal intervals, diagonally from the upper left to the lower right, i.e., from the front lateral side to the rear medial side. In this case, the stability in the diagonal directions of the cuts 40 can be maintained, and, since shear deformation in a direction intersecting the diagonal lines is promoted, lateral twisting of the foot can be prevented. As described previously, the shape of the cut region 35 where the cuts 40 are provided is not limited to an ellipse.

In a modification, diagonal cuts 40 in stripes as illustrated in FIGS. 22A and 22B can be provided in a region other than the forefoot portion. Also, in another modification, instead of diagonal stripes, longitudinal stripes or lateral stripes can be formed. Further, the stripe lines need not be parallel, as long as they do not intersect each other, and each stripe line can be a curved line, instead of a straight line.

Tenth Embodiment

In the present embodiment, one or more cuts 40 are provided to form a predetermined shape on the upper surface of the midsole 22, which differs from the first through ninth embodiments in which cuts 40 are provided in parallel or to intersect. In the following, description will be given mainly for the differences from the first through ninth embodiments, and the explanation of features in common will be omitted.

Figure 23A:
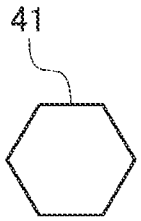
FIGS. 23A-23C are top views that schematically show the shape and arrangement of cuts in first and second examples of a tenth embodiment.
Figure 23B:
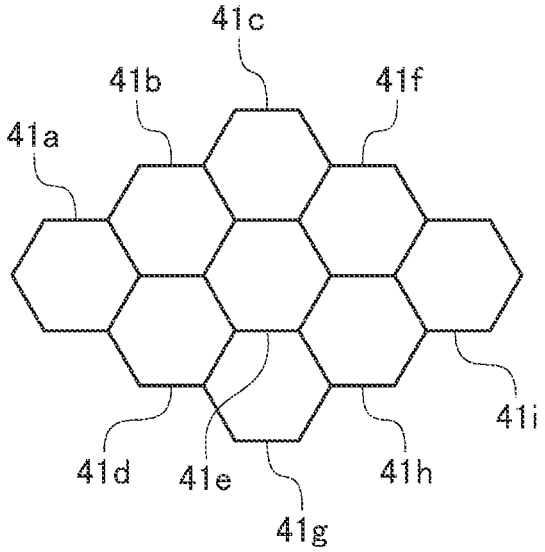
Figure 23C:
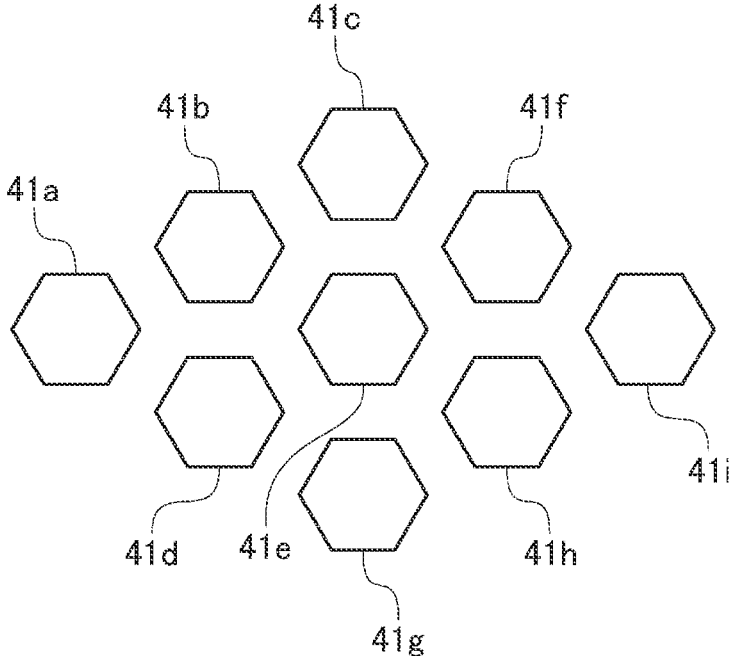

FIGS. 23A-23C are top views that schematically show the shape and arrangement of cuts in first and second examples of the tenth embodiment. In the examples of FIGS. 23A-23C, a cut pattern 41 of hexagonal shape is provided on the upper surface of the midsole 22. FIG. 23A illustrates a single cut pattern 41. One cut pattern 41 is formed by six cuts of which end points are in contact with each other to form a hexagon. FIG. 23B shows the first example in which nine cut patterns 41*a*-41*i* are arranged to be in close contact with each other and form a collective shape. FIG. 23C shows the second example in which nine cut patterns 41*a*-41*i* are arranged at intervals and form a discrete shape.

With such cuts forming a hexagonal shape, the impact buffering properties against loads in all directions can be exhibited. Also, with multiple hexagonal shapes forming a collective shape, the impact buffering properties can be further improved. Also, with multiple hexagonal shapes forming a discrete shape, both the impact buffering properties and the stability can be achieved.

Figure 24A:
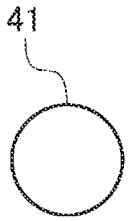
FIGS. 24A-24C are top views that schematically show the shape and arrangement of cuts in third and fourth examples of the tenth embodiment.
Figure 24B:
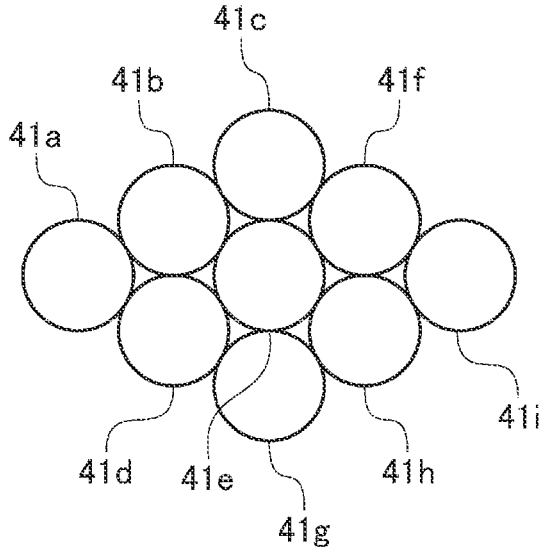
Figure 24C:
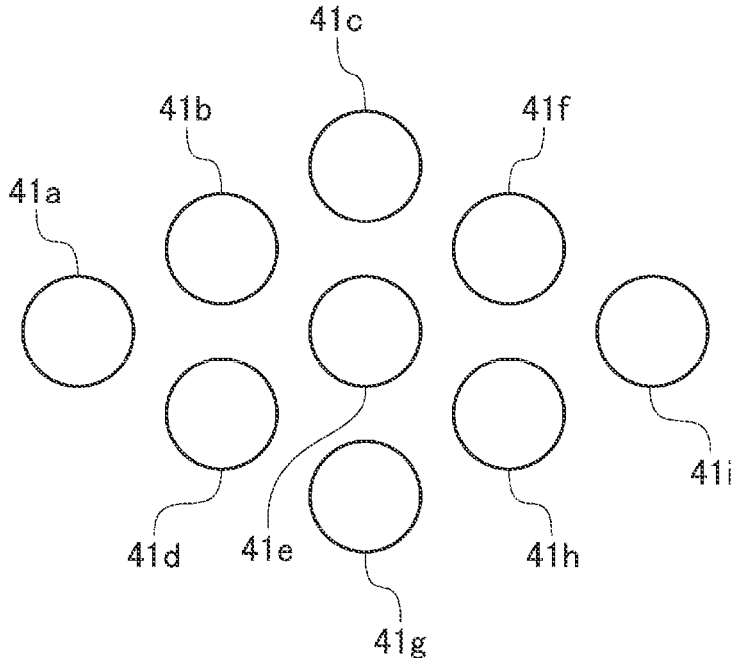

FIGS. 24A-24C are top views that schematically show the shape and arrangement of cuts in third and fourth examples of the tenth embodiment. In the examples of FIGS. 24A-24C, a cut pattern 41 of circular shape is provided on the upper surface of the midsole 22. FIG. 24A illustrates a single cut pattern 41. One cut pattern 41 is formed by a single cut looped to form a circle, with the ends of the cut in contact with each other. FIG. 24B shows the third example in which nine cut patterns 41*a*-41*i* are arranged to be in close contact with each other and form a collective shape. FIG. 24C shows the fourth example in which nine cut patterns 41*a*-41*i* are arranged at intervals and form a discrete shape.

With such cuts forming a circular shape, the impact buffering properties against loads in all directions can be exhibited. Also, with multiple circular shapes forming a collective shape, the impact buffering properties can be further improved. Also, with multiple circular shapes forming a discrete shape, both the impact buffering properties and the stability can be achieved. The circular shape can also be an ellipse, besides an exact circle.

Figure 25A:
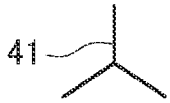
FIGS. 25A-25E are top views that schematically show the shape and arrangement of cuts in fifth through eighth examples of the tenth embodiment.

FIGS. 25A-25E are top views that schematically show the shape and arrangement of cuts in fifth through eighth examples of the tenth embodiment. In the examples of FIGS. 25A-25E, a cut pattern 41 of inverted Y shape is provided on the upper surface of the midsole 22. FIG. 25A illustrates a single cut pattern 41. One cut pattern 41 is formed by three cuts arranged radially to form an inverted Y shape, with one end of each cut meeting at one point.

Figure 25B:
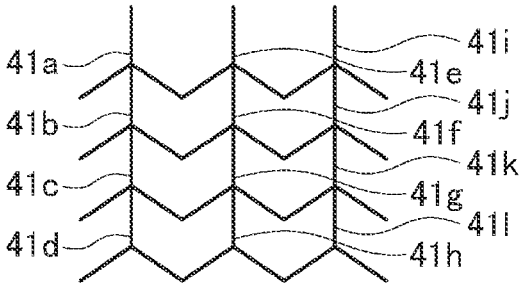
Figure 25C:
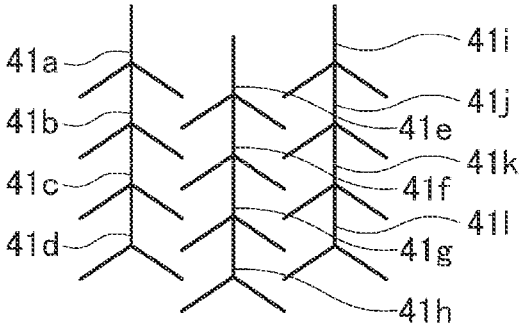

FIG. 25B shows the fifth example in which four cut patterns 41 are longitudinally connected as a column, and three columns are laterally connected, so that 12 cut patterns 41*a*-41*l* in total form a collective shape. Also, FIG. 25C shows the sixth example in which four cut patterns 41 are longitudinally connected as a column, and columns are laterally arranged with the longitudinal positions thereof shifted, so that 12 cut patterns 41*a*-41*l* in total form a collective shape. In this example, the cut patterns are arranged such that the longitudinal positions of even-numbered columns and odd-numbered columns are shifted alternately.

Figure 25D:
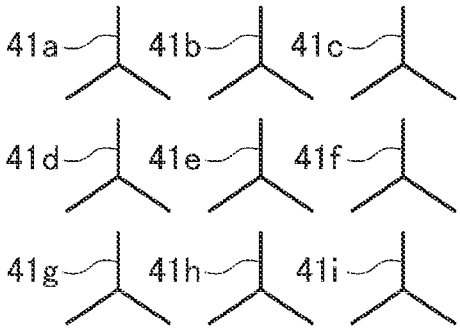
Figure 25E:
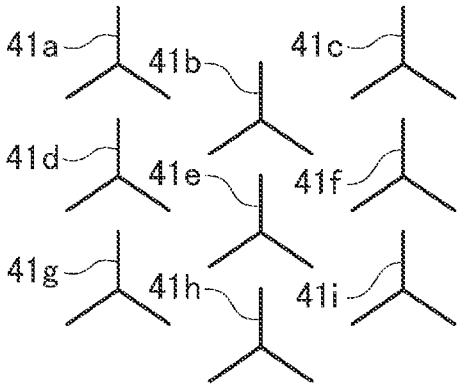

FIG. 25*d* shows the seventh example in which three cut patterns 41 are longitudinally arranged at regular intervals as a column, and three columns are laterally arranged at regular intervals, so that 9 cut patterns 41*a*-41*i* in total form a discrete shape. Also, FIG. 25*e* shows the eighth example in which three cut patterns 41 are longitudinally arranged at regular intervals as a column, and columns are laterally arranged at regular intervals, with the longitudinal positions thereof shifted, so that 9 cut patterns 41*a*-41*i* in total form a discrete shape. In this example, the cut patterns are arranged such that the longitudinal positions of even-numbered columns and odd-numbered columns are shifted alternately.

With such cuts forming an inverted Y shape, the impact buffering properties against loads in all directions can be exhibited. Also, with multiple inverted Y shapes forming a collective shape, the impact buffering properties can be further improved. Also, with multiple inverted Y shapes forming a discrete shape, both the impact buffering properties and the stability can be achieved.

Figure 26A:
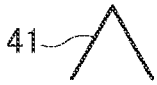

FIGS. 26A-26E are top views that schematically show the shape and arrangement of cuts in ninth through twelfth examples of the tenth embodiment. In the examples of FIGS. 26A-26E, a cut pattern 41 of inverted V shape is provided on the upper surface of the midsole 22. FIG. 26A illustrates a single cut pattern 41. One cut pattern 41 is formed by two cuts arranged to form an inverted V shape, with one end of each cut joined at one point.

Figure 26B:
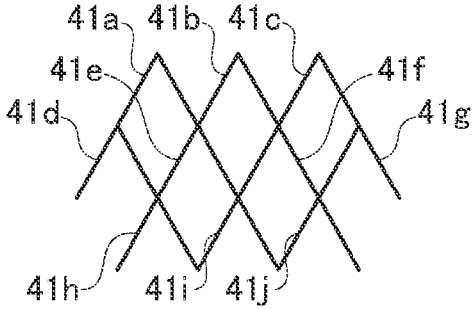
Figure 26C:
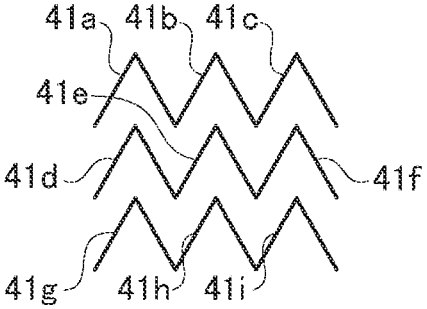

FIG. 26B shows the ninth example in which a row of three cut patterns 41 laterally connected and a row of four cut patterns 41 laterally connected are alternately connected longitudinally in three rows, so that 10 cut patterns 41*a*-41*j* in total form a collective shape. In this example, the cut patterns are arranged such that the lateral positions of even-numbered rows and odd-numbered rows are shifted alternately and the cut patterns have contact points. FIG. 26C shows the tenth example in which three cut patterns 41 are laterally connected as a row, and three rows are longitudinally arranged at regular intervals, so that 9 cut patterns 41*a*-41*i* in total form a collective shape.

Figure 26D:
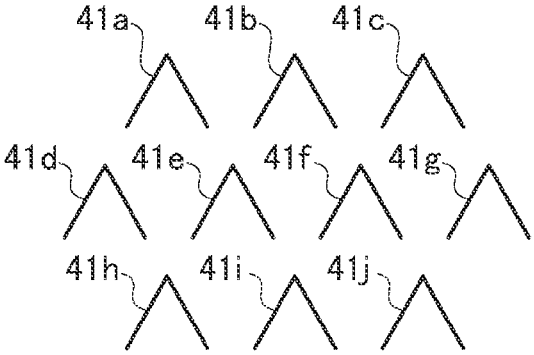
Figure 26E:
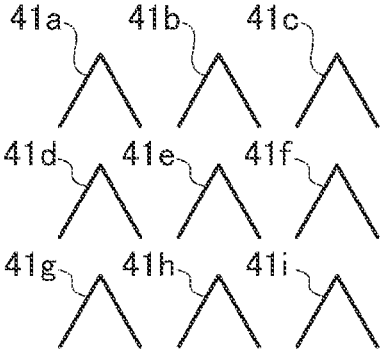

FIG. 26D shows the eleventh example in which a row of three cut patterns 41 laterally arranged at regular intervals and a row of four cut patterns 41 laterally arranged at regular intervals are alternately arranged longitudinally at regular intervals in three rows, so that 10 cut patterns 41*a*-41*j* in total form a discrete shape. In this example, the cut patterns are arranged such that the lateral positions of even-numbered rows and odd-numbered rows are shifted alternately. FIG. 26E shows the twelfth example in which three cut patterns 41 are laterally arranged at regular intervals as a row, and three rows are longitudinally arranged at regular intervals, so that 9 cut patterns 41*a*-41*i* in total form a discrete shape.

With such cuts forming an inverted V shape, the impact buffering properties against loads in all directions can be exhibited. Also, with multiple inverted V shapes forming a collective shape, the impact buffering properties can be further improved. Also, with multiple inverted V shapes forming a discrete shape, both the impact buffering properties and the stability can be achieved.

Eleventh Embodiment

The present embodiment differs from the first through tenth embodiments in that multiplex cuts are provided to form a cut pattern. In the following, description will be given mainly for the differences from the first through tenth embodiments, and the explanation of features in common will be omitted.

Figure 27A:
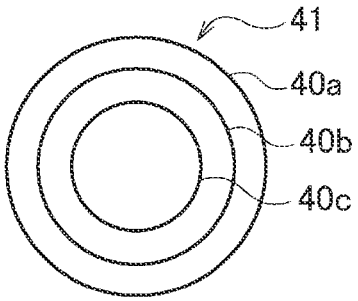
FIGS. 27A-27D are top views that schematically show first through fourth examples of a cut pattern in an eleventh embodiment.

FIGS. 27A-27D are top views that schematically show first through fourth examples of a cut pattern in the eleventh embodiment. FIG. 27A, which shows the first example, illustrates a cut pattern 41 in which three circular cuts 40*a*-40*c* are concentrically nested. Although FIG. 27A illustrates the cut pattern 41 of nested exact circles, in a modification, elliptic, polygonal, or other loop-shaped cuts can be nested, or multiplex non-looped straight lines or curved lines can be arranged. In this way, by arranging nested or multiplex cuts, cuts can be provided intensively in a region where deformation is particularly required, thereby improving the impact buffering properties. Also, by changing the shape or arrangement of such cut patterns as described in the following second through tenth examples, cuts can be provided locally in an area where deformation is particularly required.

Figure 27B:
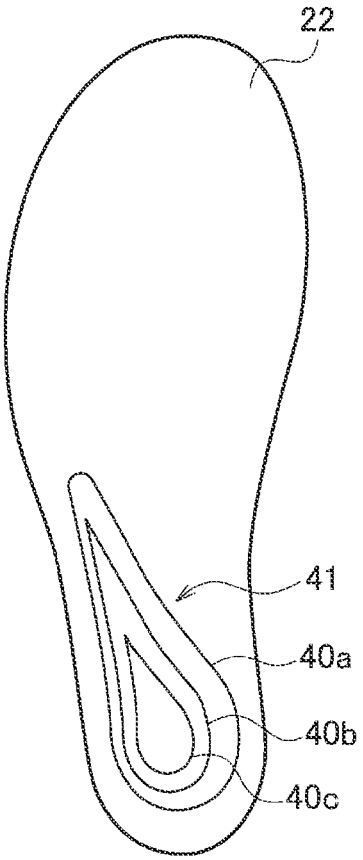

In the second example shown in FIG. 27B, a cut pattern 41 of fan shape is provided in an area including a region supporting the entire heel and a region supporting the lateral side of the midfoot portion such as to extend and taper off from the entire heel toward the lateral side of the midfoot portion. In the cut pattern 41 of the second example, three fan-shaped cuts 40 of the same shape but different sizes are arranged to be nested. More specifically, within a first cut 40*a* of fan shape, a smaller second cut 40*b* is provided, and, within the second cut 40*b*, a further smaller third cut 40*c* is provided, thereby forming the cut pattern 41. To make the effect of the cuts larger particularly on the lateral side, the first cut 40*a*, the second cut 40*b*, and the third cut 40*c* of the cut pattern 41 are each located slightly closer to the lateral side and are arranged such that the intervals between the cuts on the lateral side are narrower than those on the medial side. The intervals between the first cut 40*a*, the second cut 40*b*, and the third cut 40*c* on the lateral side need not be equal, and the interval between the first cut 40*a* and the second cut 40*b* can be narrower than the interval between the second cut 40*b* and the third cut 40*c*.

The line of each cut illustrated in FIGS. 27A-27D or FIGS. 28A-28F need not necessarily indicate the position or shape of the cut, and the distribution or unevenness of the positions of cuts, number of cuts, density, and the like can be indicated by the distribution or unevenness of the positions of cuts, number of cuts, narrowness of the intervals, shading, and the like. For example, the number or density of various shapes of cuts or that of cut patterns as described in the tenth embodiment can be increased toward the lateral side and can be reduced toward the medial side. Also, the shape, depth, incidence angle, and the like of cuts or cut patterns can be changed so that the deformation of the midsole 22 becomes larger toward the lateral side and becomes smaller toward the medial side. As described previously, also in FIGS. 27A-27D and FIGS. 28A-28F, each linear cut can be any of solid, dotted, chain, straight, and curved lines. Therefore, the density of the cuts can be increased intensively in a region where deformation is particularly required, so that the impact buffering properties can be improved.

Figure 27C:
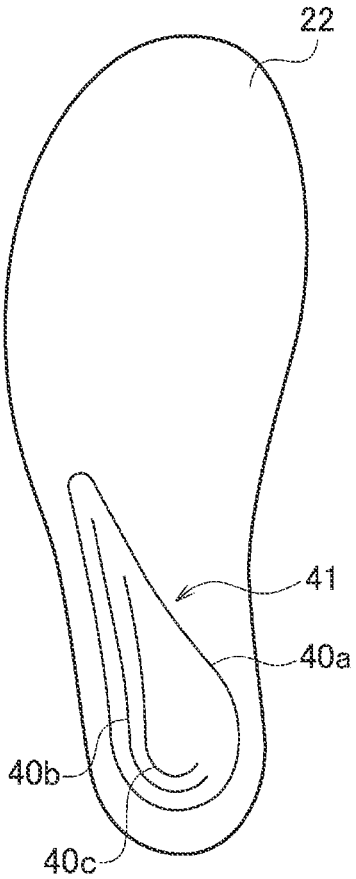

In the third example shown in FIG. 27C, a cut pattern 41 of fan shape is provided in a region similar to that shown in FIG. 27B such as to extend and taper off from the entire heel toward the lateral side of the midfoot portion. However, unlike the second example, only a first cut 40*a* located outermost is fan-shaped in the cut pattern 41 of the third example, and each of a second cut 40*b* and a third cut 40*c* located therein has a shape of only a partial curved line on the lateral side of a fan shape and does not include a curved portion on the medial side. Thus, the cuts 40 are arranged such that the difference between the effects of cuts on the lateral side and the medial side in the cut pattern 41 of the third example becomes larger than that in the cut pattern 41 of the second example.

Figure 27D:
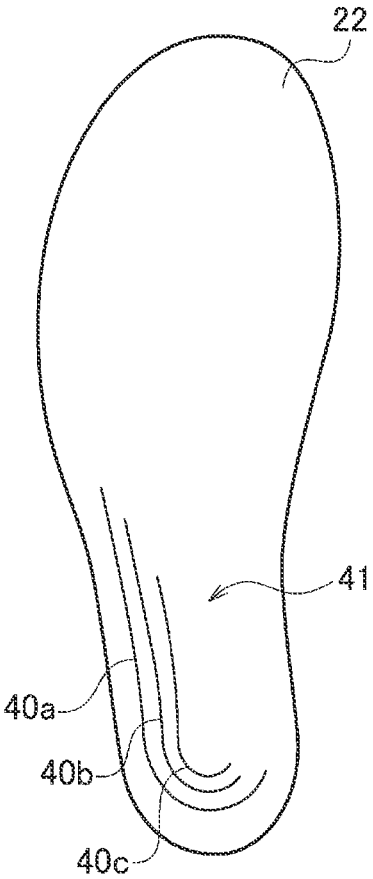

In the fourth example shown in FIG. 27D, a cut pattern 41 is provided in a region similar to that shown in FIG. 27B or 27C such as to extend from the entire heel toward the lateral side of the midfoot portion. However, unlike the third example, a first cut 40*a* located outermost is not fan-shaped either in the cut pattern 41 of the fourth example, and, as with a second cut 40*b* and a third cut 40*c* located therein, the first cut 40*a* also has a shape of only a partial curved line on the lateral side of a fan shape and does not include a curved portion on the medial side. Thus, the cuts 40 are arranged such that the difference between the effects of cuts on the lateral side and the medial side in the cut pattern 41 of the fourth example becomes larger than that in the cut pattern 41 of the third example.

FIGS. 28A-28F are top views that schematically show fifth through tenth examples of a cut pattern in the eleventh embodiment.

Figure 28A:
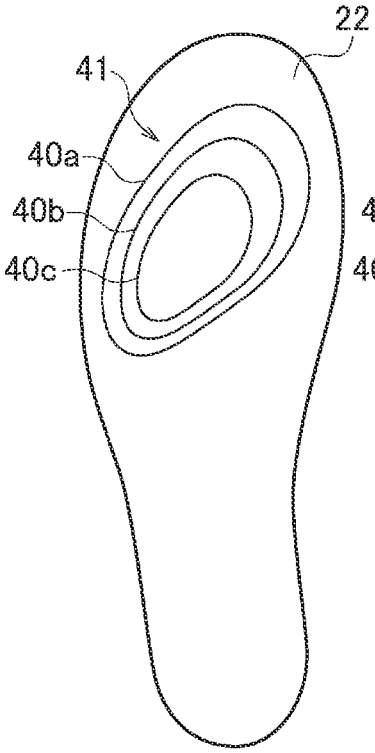
FIGS. 28A-28F are top views that schematically show fifth through tenth examples of a cut pattern in the eleventh embodiment.

In the fifth example shown in FIG. 28A, a cut pattern 41 of egg shape is provided in an area including a region supporting the entire forefoot portion and a region supporting the lateral side of the midfoot portion such as to extend from the entire forefoot portion toward the lateral side of the midfoot portion. In the cut pattern 41 of the fifth example, three egg-shaped cuts 40 of the same shape but different sizes are arranged to be nested. More specifically, within a first cut 40*a* of egg shape, a smaller second cut 40*b* is provided, and, within the second cut 40*b*, a further smaller third cut 40*c* is provided, thereby forming the cut pattern 41. To make the effect of the cuts larger particularly on the lateral side, the first cut 40*a*, the second cut 40*b*, and the third cut 40*c* of the cut pattern 41 are each located slightly closer to the lateral side and are arranged such that the intervals between the cuts on the lateral side are narrower than those on the medial side. The intervals between the first cut 40*a*, the second cut 40*b*, and the third cut 40*c* on the lateral side need not be equal, and the interval between the first cut 40*a* and the second cut 40*b* can be narrower than the interval between the second cut 40*b* and the third cut 40*c*.

Figure 28B:
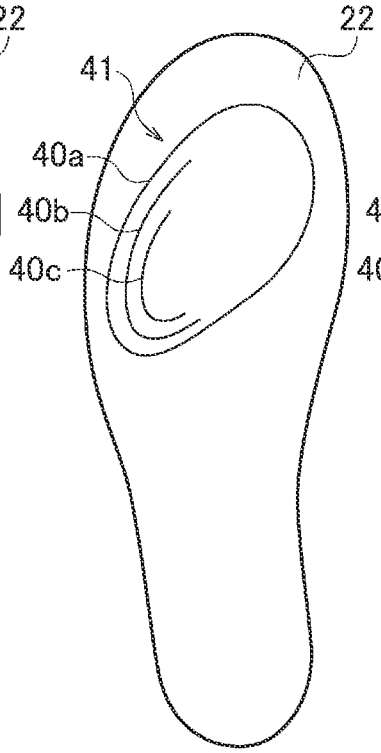

In the sixth example shown in FIG. 28B, a cut pattern 41 of egg shape is provided in a region similar to that shown in FIG. 28A such as to extend from the entire forefoot portion toward the lateral side of the midfoot portion. However, unlike the fifth example, only a first cut 40*a* located outermost is egg-shaped in the cut pattern 41 of the sixth example, and each of a second cut 40*b* and a third cut 40*c* located therein has a shape of only a partial curved line on the lateral side of an egg shape and does not include a curved portion on the medial side. Thus, the cuts 40 are arranged such that the difference between the effects of cuts on the lateral side and the medial side in the cut pattern 41 of the sixth example becomes larger than that in the cut pattern 41 of the fifth example.

Figure 28C:
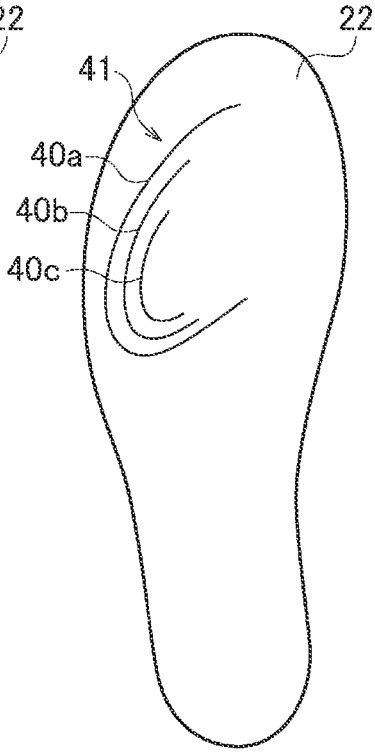

In the seventh example shown in FIG. 28C, a cut pattern 41 is provided in a region similar to that shown in FIG. 28A or 28B such as to extend from the entire forefoot portion toward the lateral side of the midfoot portion. However, unlike the sixth example, a first cut 40*a* located outermost is not egg-shaped either in the cut pattern 41 of the seventh example, and, as with a second cut 40*b* and a third cut 40*c* located therein, the first cut 40*a* also has a shape of only a partial curved line on the lateral side of an egg shape and does not include a curved portion on the medial side. Thus, the cuts 40 are arranged such that the difference between the effects of cuts on the lateral side and the medial side in the cut pattern 41 of the seventh example becomes larger than that in the cut pattern 41 of the sixth example.

Figure 28D:
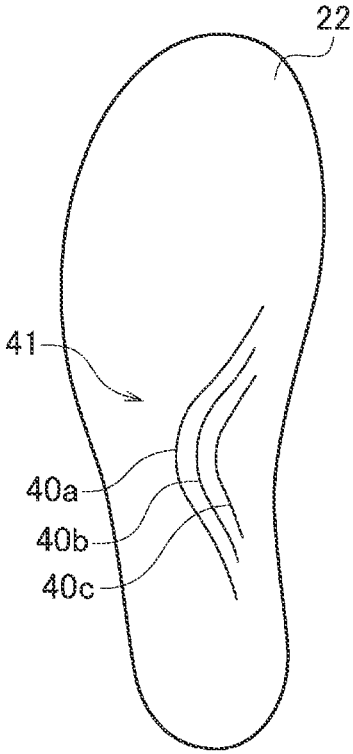

In the eighth example shown in FIG. 28D, a cut pattern 41 of mountain-like curved shape is provided in a region from a center part to the medial side of the midfoot portion. The cut pattern 41 of the eighth example includes three cuts of a first cut 40*a*, a second cut 40*b*, and a third cut 40*c* of curved shape parallel to each other, provided in a longitudinal direction on the medial side of the midfoot portion. Each of the cuts has a mountain-like curved shape such that a middle portion thereof is prominent toward the center of the midfoot portion. In other words, each of the three cuts of the first cut 40*a*, the second cut 40*b*, and the third cut 40*c* draws a curved line such that the middle thereof is diverted from the medial side and located closer to the center of the midfoot portion, and the both ends of the curved line are positioned respectively in a front part and a rear part of the midfoot portion on the medial side. The medial side of the midfoot portion is a region mainly corresponding to the arch of the wearer; in the case of the eighth example, the density of the cuts in the midfoot portion is higher on the center side than on the medial side, and the rigidity is relatively higher on the medial side than on the center side. Therefore, the effects of preventing lowering of the wearer's arch and preventing pronation can be expected.

Figure 28E:
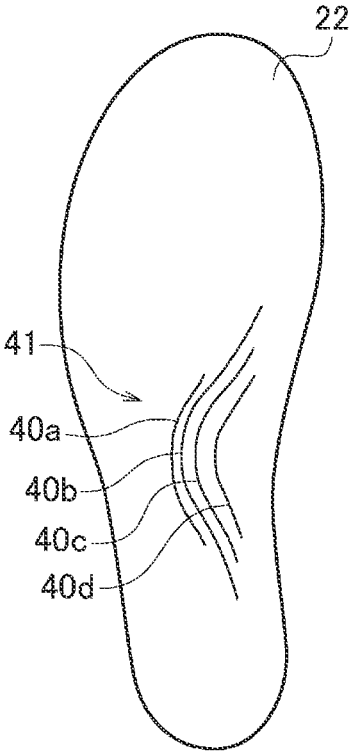

In the ninth example shown in FIG. 28E, a cut pattern 41 of mountain-like curved shape is provided in a region similar to that shown in FIG. 28D from a center part to the medial side of the midfoot portion. The cut pattern 41 of the ninth example has one more cut than the cut pattern 41 of the eighth example and hence includes four cuts of a first cut 40*a*, a second cut 40*b*, a third cut 40*c*, and a fourth cut 40*d* of curved shape parallel to each other, provided in a longitudinal direction on the medial side of the midfoot portion. Each of the first cut 40*a*, the second cut 40*b*, the third cut 40*c*, and the fourth cut 40*d* has a mountain-like shape such that a middle portion thereof is prominent toward the center of the midfoot portion, and the cuts are arranged such that the intervals between the curved lines closer to the center are narrower than those on the medial side. In the case of the ninth example, the number of cuts is larger, the intervals between the cuts are narrower, and the density is relatively higher on the center side, compared to on the medial side, so that the rigidity is relatively higher on the medial side than on the center side. Therefore, the effects of preventing lowering of the wearer's arch and preventing pronation can be expected.

Figure 28F:
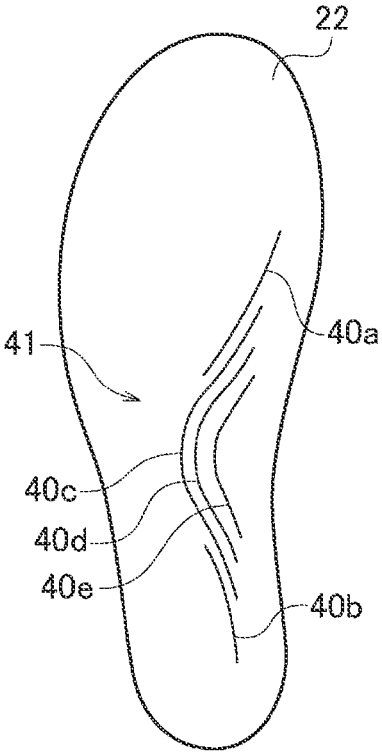

In the tenth example shown in FIG. 28F, a cut pattern 41 of mountain-like curved shape is provided in a region similar to that shown in FIG. 28D or 28E from a center part to the medial side of the midfoot portion. The cut pattern 41 of the tenth example has one more cut than the cut pattern 41 of the ninth example and hence includes five cuts of a first cut 40*a*, a second cut 40*b*, a third cut 40*c*, a fourth cut 40*d*, and a fifth cut 40*e* of curved shape parallel to each other, provided in a longitudinal direction on the medial side of the midfoot portion. Each of the third cut 40*c*, the fourth cut 40*d*, and the fifth cut 40*e* has a mountain-like shape such that a middle portion thereof is prominent toward the center of the midfoot portion. The first cut 40*a* is provided on the medial side closer to the forefoot portion, and the second cut 40*b* is provided on the medial side closer to the heel portion. In the case of the tenth example, the intervals between the cuts are wider and the number of cuts is smaller on the medial side than on the center side, and fewer cuts are provided on the medial side compared to the forefoot portion side or the heel portion side, so that the rigidity is relatively higher on the medial side. Therefore, the effects of preventing lowering of the wearer's arch and preventing pronation can be expected.

Twelfth Embodiment

In the present embodiment, the incidence angle of a cut provided on the midsole 22 is oblique, which differs from the first through eleventh embodiments in which the incidence angle of a cut is perpendicular to the upper surface or the lower surface of the midsole 22. In the following, description will be given mainly for the differences from the first through eleventh embodiments, and the explanation of features in common will be omitted.

Figure 29A:
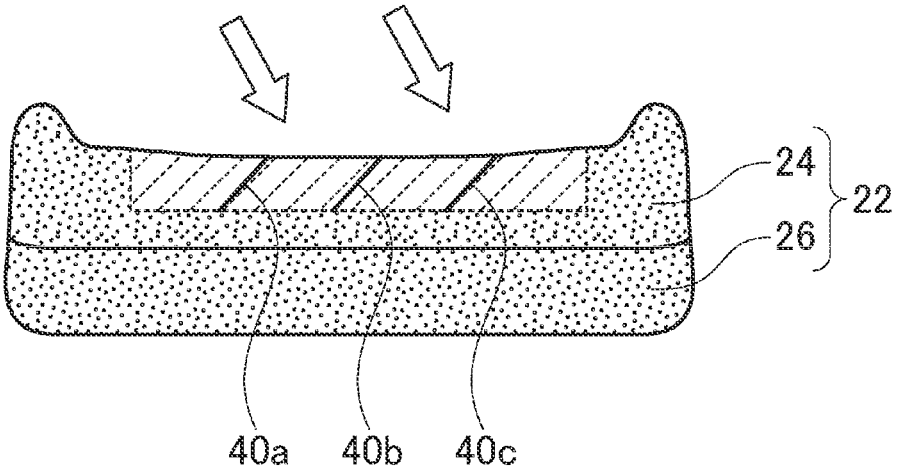
FIGS. 29A and 29B are end views that schematically show the incidence angles of cuts in first and second examples of a twelfth embodiment.
Figure 29B:
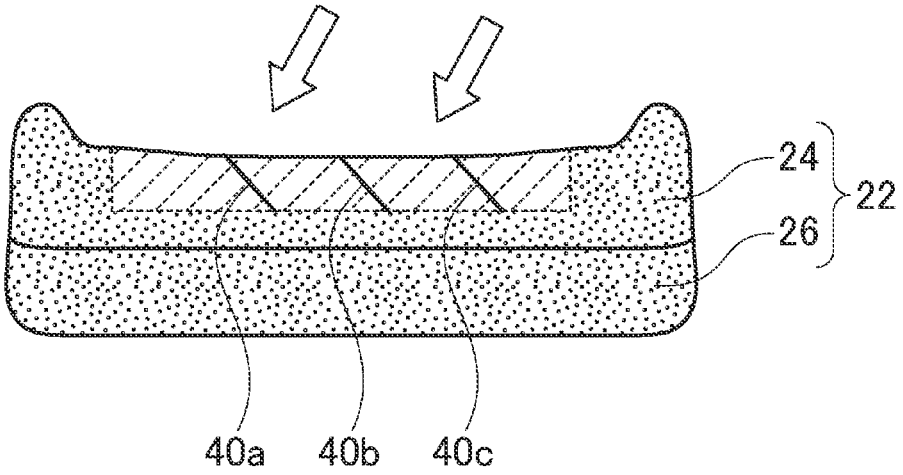

FIGS. 29A and 29B are end views that schematically show the incidence angles of cuts in first and second examples of the twelfth embodiment. FIGS. 29A and 29B are end views in a foot width direction of the midsole 22.

In the first example shown in FIG. 29A, three cuts 40*a*-40*c* are provided to have an incidence angle set obliquely downward from the medial side to the lateral side in a foot width direction. In this case, when a load is applied to the medial side as indicated by the arrows, shear deformation of the midsole 22 can be promoted, and the impact buffering properties can be improved.

In the second example shown in FIG. 29B, three cuts 40*a*-40*c* are provided to have an incidence angle set obliquely downward from the lateral side to the medial side in a foot width direction. In this case, when a load is applied to the lateral side as indicated by the arrows, shear deformation of the midsole 22 can be promoted, and the impact buffering properties can be improved.

Figure 30A:
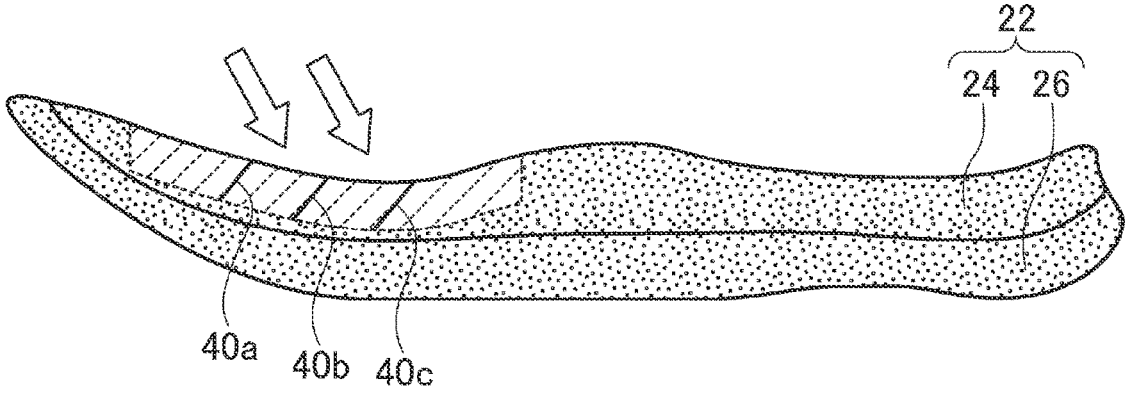
FIGS. 30A and 30B are end views that schematically show the incidence angles of cuts in third and fourth examples of the twelfth embodiment.
Figure 30B:
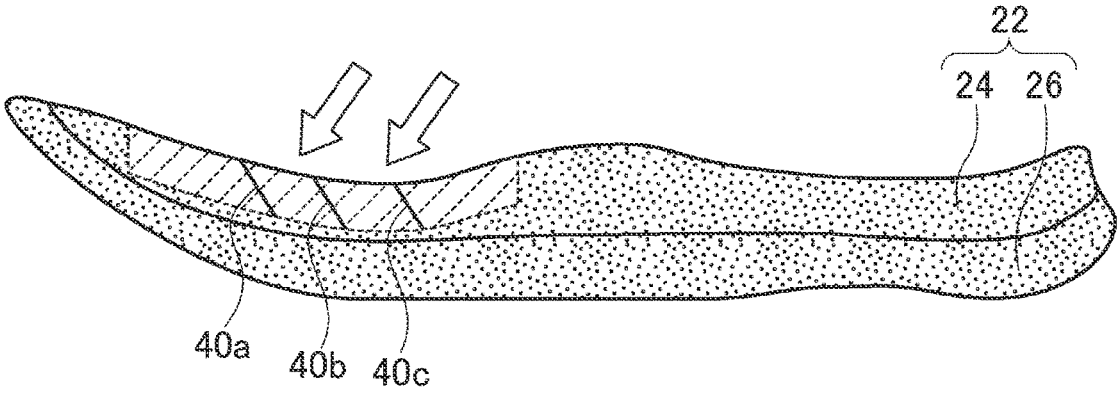

FIGS. 30A and 30B are end views that schematically show the incidence angles of cuts in third and fourth examples of the twelfth embodiment. FIGS. 30A and 30B are end views in a foot length direction of the midsole 22.

In the third example shown in FIG. 30A, three cuts 40*a*-40*c* are provided to have an incidence angle set obliquely downward from the rear side to the front side in a foot length direction. In this case, when a load is applied to the rear side as indicated by the arrows, shear deformation of the midsole 22 can be promoted, and the impact buffering properties can be improved.

In the fourth example shown in FIG. 30B, three cuts 40*a*-40*c* are provided to have an incidence angle set obliquely downward from the front side to the rear side in a foot length direction. In this case, when a load is applied to the front side as indicated by the arrows, shear deformation of the midsole 22 can be promoted, and the impact buffering properties can be improved.

Figure 31:
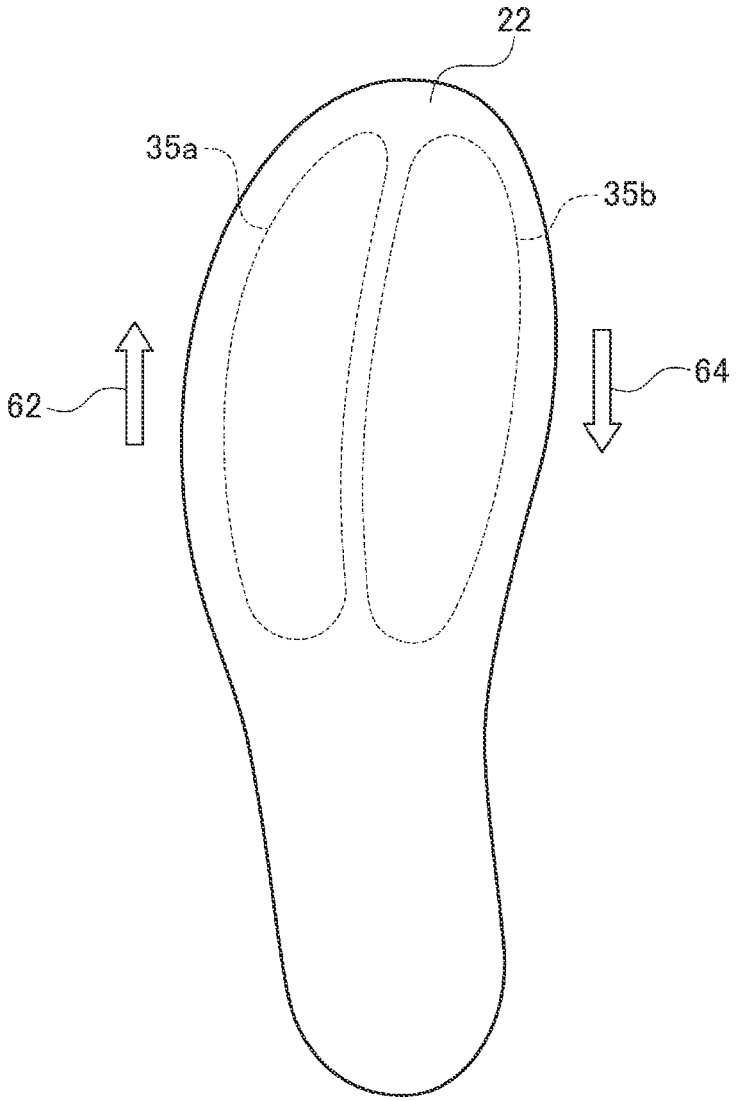
FIG. 31 is a top view that schematically shows the incidence angles of cuts in a fifth example of the twelfth embodiment.

FIG. 31 is a top view that schematically shows the incidence angles of cuts in a fifth example of the twelfth embodiment. In the fifth example, in a cut region 35*a*, which is a region from the lateral side of the forefoot portion to the lateral side of the midfoot portion in the midsole 22, a cut 40 is provided to have an incidence angle set obliquely downward from the front side to the rear side in a foot length direction, as is the case in the fourth example of FIG. 30B. Therefore, on the lateral side, when a load is applied in the load direction at the time of landing, i.e., to the front side as indicated by the arrow 62, shear deformation of the midsole 22 can be promoted, and the impact buffering properties can be improved.

Meanwhile, in a cut region 35*b*, which is a region from the medial side of the forefoot portion to the medial side of the midfoot portion in the midsole 22, a cut 40 is provided to have an incidence angle set obliquely downward from the rear side to the front side in a foot length direction, as is the case in the third example of FIG. 30A. Therefore, on the medial side, when a load is applied in the load direction at the time of pushing off, i.e., to the rear side as indicated by the arrow 64, shear deformation of the midsole 22 can be promoted, and the impact buffering properties can be improved.

The present invention has been described with reference to embodiments. The embodiments are intended to be illustrative only, and it will be obvious to those skilled in the art that various modifications to a combination of constituting elements or processes could be developed and that such modifications also fall within the scope of the present invention.

What is claimed is:

1. A shoe, comprising:

a sole comprising an inner sole, a midsole below the inner sole, and an outsole below the midsole, the outsole being configured to be in contact with the ground, the sole having a forefoot region, a midfoot region, and a heel region; and an upper joined to the sole, wherein in the midsole, at least one cut of linear shape is provided which has a depth from a first height position to a second height position in a thickness direction, the cut is provided in the heel region on an upper surface in the midsole, the cut is configured such that no part of the cut intersects with another part of the cut at the upper surface in the midsole and such that no part of the cut intersects with another cut at the upper surface of the midsole, the cut forms a V shape at the second height position as viewed at a cross section when opposite inner walls of the cut are spaced away from each other while a load is applied through the upper, and the opposite inner walls are in contact with each other in a normal state when the load is not applied through the upper, and the inner sole covers the cut.

2. The shoe according to claim 1, wherein the cut is provided in an area locally lying in at least one of a lateral region or a medial region of the midsole.

3. The shoe according to claim 1, wherein the cut is provided in a region other than a region where the load applied while the shoe is worn is relatively smaller or relatively larger than other regions.

4. The shoe according to claim 2, wherein the cut is provided in a region other than a region where the load applied while the shoe is worn is relatively smaller or relatively larger than other regions.

5. The shoe according to claim 1, wherein the cut is a plurality of cuts provided at a plurality of discrete positions and having a predetermined linear shape.

6. The shoe according to claim 1, wherein the cut is a plurality of cuts provided at a plurality of positions at intervals such that the density differs from the density in another area.

7. The shoe according to claim 2, wherein the cut is a plurality of cuts provided at a plurality of positions at intervals such that the density in the area locally lying differs from the density in another area.

8. The shoe according to claim 1, wherein the cut is formed such that the depth thereof differs according to a difference in distance to an end of the midsole.

9. The shoe according to claim 1, wherein the cut is formed in an oblique direction from a front medial portion to a rear lateral portion or from a front lateral portion to a rear medial portion.

10. The shoe according to claim 1, wherein the inner sole covers the cut and contacts the upper surface in the midsole surrounding the cut in the normal state when the load is not applied through the upper.

11. The shoe according to claim 10, wherein the cut is provided in an area locally lying in at least one of a lateral region or a medial region of the midsole.

12. The shoe according to claim 10, wherein the cut is provided in a region other than a region where the load applied while the shoe is worn is relatively smaller or relatively larger than other regions.

13. The shoe according to claim 11, wherein the cut is provided in a region other than a region where the load applied while the shoe is worn is relatively smaller or relatively larger than other regions.

14. The shoe according to claim 10, wherein the cut is a plurality of cuts provided at a plurality of discrete positions and having a predetermined linear shape.

15. The shoe according to claim 11, wherein the cut is a plurality of cuts provided at a plurality of positions at intervals such that the density in the area locally lying differs from the density in another area.

16. The shoe according to claim 10, wherein the cut is formed such that the depth thereof differs according to a difference in distance to an end of the midsole.

17. The shoe according to claim 10, wherein the cut is formed in an oblique direction from a front medial portion to a rear lateral portion or from a front lateral portion to a rear medial portion.

* * * * *